United States Patent [19]

Kokubo et al.

[11] 3,947,943

[45] Apr. 6, 1976

[54] CABLE HARNESS FORMING MACHINE COMPRISING WIRE FEED-OUT MEANS IN HARNESS LAYING HEAD

[75] Inventors: Takamasa Kokubo; Mikio Sakai; Tomohide Inada; Takashi Nakanishi; Hiroshi Seki; Hazime Yaegashi; Kouji Izumi; Morio Matsumura; Takao Nomura; Hisakazu Kato, all of Tokyo, Japan

[73] Assignee: Nippon Electric Company Limited, Tokyo, Japan

[22] Filed: July 1, 1974

[21] Appl. No.: 485,034

[30] Foreign Application Priority Data

| | | |
|---|---|---|
| June 30, 1973 | Japan | 48-74069 |
| June 30, 1973 | Japan | 48-74070 |
| June 30, 1973 | Japan | 48-74071 |
| June 30, 1973 | Japan | 48-74072 |

[52] U.S. Cl. ..... 29/203 MW; 29/203 B; 29/203 P; 29/624; 140/92.1

[51] Int. Cl.[2] ..... H01R 43/00; H01B 13/00

[58] Field of Search ..... 27/624, 203 B, 203 MW, 27/203 P, 203 C, 203 R; 140/92.1, 93; 29/241; 317/119, 122

[56] References Cited

UNITED STATES PATENTS

| | | | |
|---|---|---|---|
| 3,693,228 | 9/1972 | Logan | 29/203 MW |
| 3,804,130 | 4/1974 | Tarbox et al. | 29/203 X B |
| 3,842,496 | 10/1974 | Mercer | 29/624 |

*Primary Examiner*—C. W. Lanham
*Assistant Examiner*—Dan C. Crane
*Attorney, Agent, or Firm*—Sughrue, Rothwell, Mion, Zinn & Macpeak

[57] ABSTRACT

A machine comprises a wire station for supplying various wires, a harness board on which a cable harness is to be formed, and a harness laying head movable relative to the harness board for receiving selected one of the wires from the wire station laying the selected wire on the harness board. The wire station comprises a plurality of wire clampers for releasably clamping the respective wires with their free ends protruding approximately a predetermined length towards the harness laying head. The head comprises a wire feed-in station operable in its wire released mode of receiving therein the selected wire and in its wire take-up made of taking up the wire received therein, a wire storing station for storing the taken-up wire therein, a wire feed-out station operable in its wire driving mode of positively driving the stored wire to the outside of the head and in its wire holding mode of immovably holding the selected wire, a cutter for cutting the wire held by the feed-out station into a first section having a trailing end in the head and a second section having a leading end also in the head, and a wire pusher for pushing the trailing end substantially out of the head.

26 Claims, 25 Drawing Figures

FIG. 6A
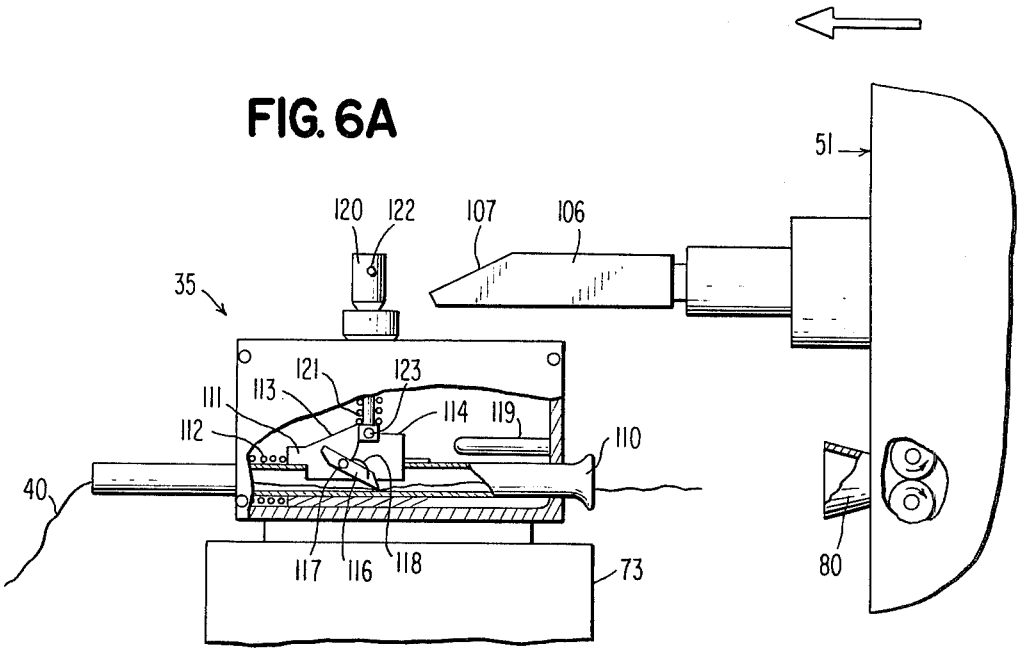
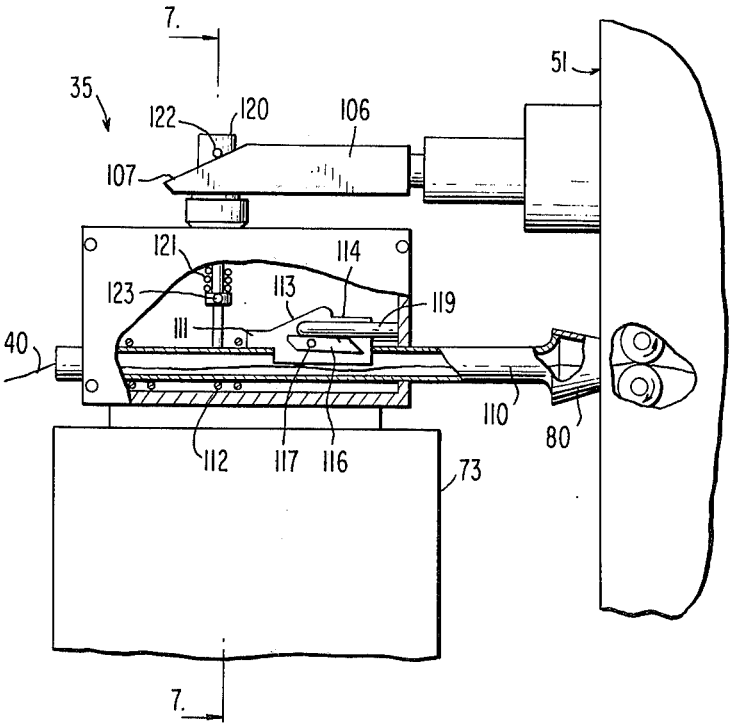
FIG. 6B
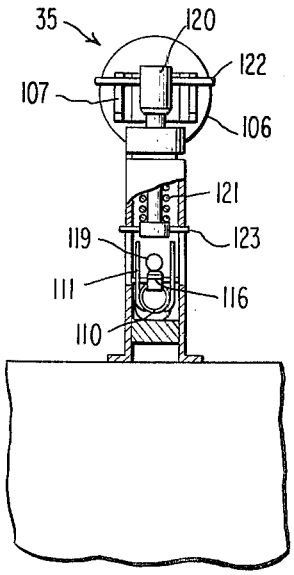
FIG. 7

FIG. 19
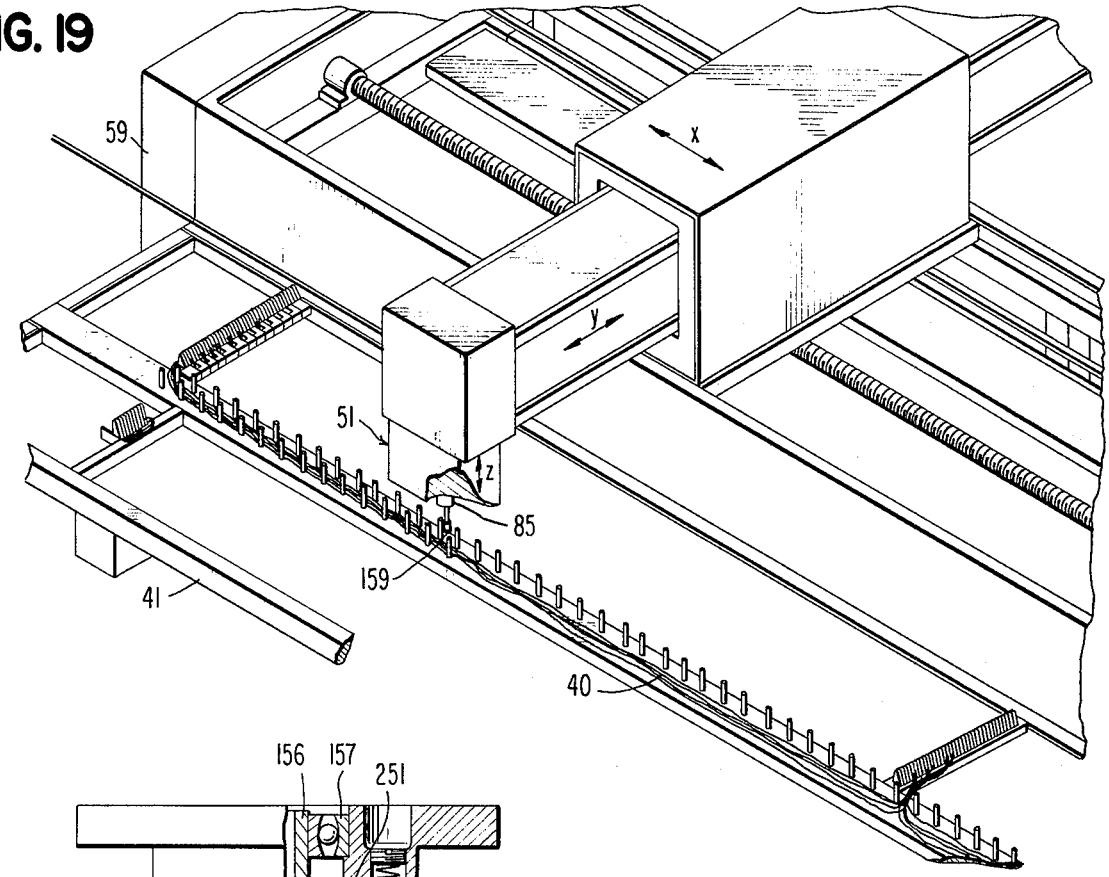
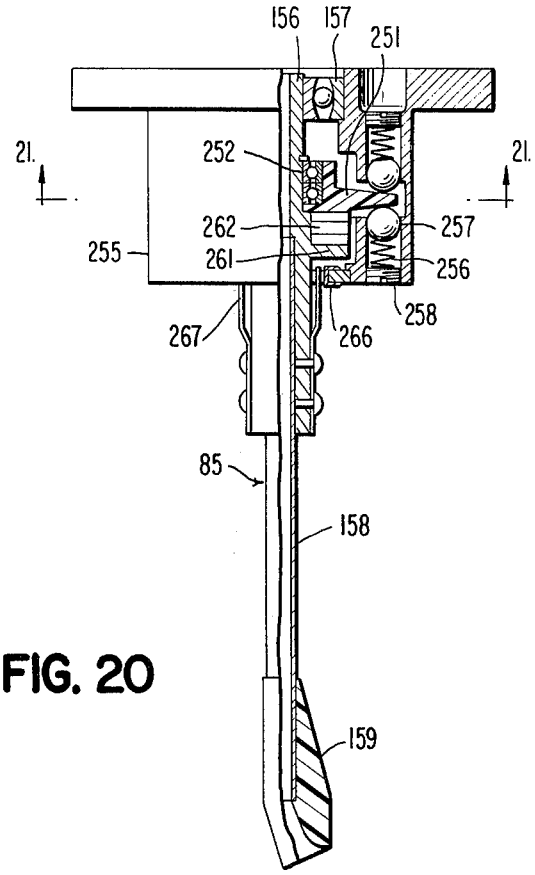
FIG. 20
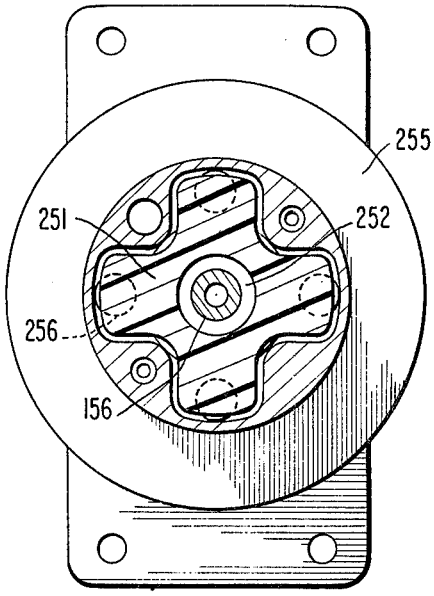
FIG. 21

CABLE HARNESS FORMING MACHINE COMPRISING WIRE FEED-OUT MEANS IN HARNESS LAYING HEAD

BACKGROUND OF THE INVENTION

This invention relates to a machine for forming a cable harness which is a bundle of various wires for use in providing electric connections among a plurality of subunits in a telephone exchanger, a like exchanger, an electronic computer, or a similar electric or electronic device. The subunits may be printed circuits.

A conventional automatic cable harness forming machine comprises a harness laying head and a numerical control unit for driving the head in accordance with a desired pattern for each wire of the cable harness. The machine is used in combination with a harness board on which the cable harness is to be formed. However, a conventional machine still has many defects which must be obviated before field use of such machines is rendered feasible. Typical defects reside in means for enabling the head to dispose of the wires from which the wire segments forming the cable harness are subsequently cut, in means for processing a wire end, and in means for holding the wires at their bends in the general pattern.

In one type of the conventional machines, a plurality of reels for the wires are carried by the head. It is possible with this type to simplify the mechanism for supplying predetermined one of the wires to the head. The head, however, can accommodate only several kinds of wires, whereas a cable harness for a crossbar telephone exchanger comprises wire segments formed of wires of about twenty kinds. In addition, it has been difficult to achieve controlled tension in the wire being laid on the harness board.

In another type of the conventional machines, such as disclosed in Japanese Pat. Disclosure No. Syo 48-59398, the head lays the wire in an endless manner on the harness board for the wire segments of one and the same wire. The wire is subsequently manually cut into the wire segments. This is troublesome, results in loss of the wires, and is liable to erroneous cutting. These disadvantages grow more serious in a cable harness comprising as many as two thousand wire segments for use in a crossbar exchanger of medium size. In an attempt for obviating the disadvantages, the head is equipped with a cutter for cutting the wire into a wire segment as soon as the head laid each of the wire on the harness board. It, however, is difficult even with this attempt to control the skinner length which is a length between a wire end tip and the point from where the wire end branches.

A harness board has a plurality of pins attached thereto in conformity with the pattern of the cable harness to be formed thereon. The pin positions may be changeable. The pins retain the wire ends and hold or guide the bends of the wire segments. The pins, however, are unreliable, require a wide area around each thereof to retain and hold the wire segments, and are accordingly unsuited for a cable harness having closely spaced branches, or wire segment groups, and twigs, or wire segment subgroups each comprising ten to twenty wire segments, such as one for the crossbar switchboard use where the distances between the adjacent branches and between the adjacent twigs are about 50 mm and only 6.5 mm, respectively.

SUMMARY OF THE INVENTION:

It is therefore an object of the present invention to provide a machine for use in combination with a harness board and a wire supply station accommodating a large number of wires, for forming a cable harness on the harness board, wherein the machine comprises a harness laying or operating head capable of laying the wire on the harness board with controlled tension.

It is another object of this invention to provide a machine of the type described, wherein the harness laying head is capable of precisely controlling the skinner lengths of the cable harness.

It is a further object of this invention to provide a wire supply station for use in combination with a machine of the type described, capable of supplying predetermined one of a large number of wires to the harness laying head with controlled tension of the predetermined wire.

It is a still further object of this invention to provide a harness board for use in combination with the machine of the type described, capable of reliably retaining free ends of wire segments of the cable harness with close spacings between adjacent twigs of the cable harness.

It is a yet further object of this invention to provide a harness board of the type described, capable of reliably holding the wire segments with close spacings between adjacent branches of the cable harness.

A machine according to this invention, used in combination with a wire supply station and a harness board, is capable of forming a cable harness comprising a plurality of wire segments on the harness board. The supply station accommodates a plurality of wires from which the wire segments are subsequently cut. The harness board has wire end retainer means attached thereto for retaining a free end of a wire. The machine comprises a harness laying head and head control means for moving the head relative to the harness board and supply station. The head is capable of receiving predetermined one of the wires from the supply station and of supplying the predetermined wire to the harness board to allow the free end of the predetermined wire to be retained by the retainer means, thereby laying the predetermined wire on the harness board to provide one of the wire segments. In accordance with this invention, the head comprises a wire feed-out station operable in a wire driving mode of positively driving the predetermined wire to the harness board, in a wire holding mode of holding the predetermined wire immovably relative to the head, and in a wire passage mode of allowing free passage therethrough of the predetermined wire. Also in accordance with this invention, the head control means comprises feed-out station control means for operating the feed-out station in timed relation to the movement of the head selectively in one of the wire driving mode in which the free end of the predetermined wire may be retained by the retainer means, the wire holding mode in which one of the wire segments may be cut from the predetermined wire, and the wire passage mode in which the predetermined wire may be laid on the harness board as the head is moved by the head control means.

The wire supply station mentioned above may comprise a plurality of reels for the wires. In accordance with an aspect of this invention, the wire supply station comprises a plurality of wire clampers for the respective wires which continue to the reels and have free ends. Each of the clampers has a forward side to be directed to the machine and harness board and comprises first means for holding relavant one of the wires releasably and immovably relative to the harness board with the free end of the relevant wire projected approximately a preselected length forwardly of the forward side and second means operatively coupled to the first means and operable by the head put in a predetermined position relative to the forward side to release the holding by the first means of the relevant wire, thereby allowing the relevant wire to be received at the projected free end by the head put in the predetermined position.

The wire end retainer means of the harness board mentioned above may include a base whereby the retainer means is attached to the harness board. On the other hand, the harness laying head may comprise a wire outlet tube protruding towards the harness board for guiding the predetermined wire therethrough from the feed-out station to the harness board. In accordance with another aspect of this invention, the wire end retainer means comprises a peripheral wall defining a hole through the base for free passage therethrough of the wire outlet tube, a pair of wire retainer rods fixed to the base on one side of the hole so as to allow free passage therebetween of the wire outlet tube transversely thereof, and a sheet of a resilient material held by the base extending into the hole from the other side thereof with a portion of the hole left between an edge of the sheet disposed in the hole and an opposing portion of the wall. The sheet has a slit communicating with the hole portion and being yieldable to allow putting thereinto of the wire outlet tube by the head moved by the head control means and capable of holding the wire guided by and protruded from the wire outlet tube after pulling of the wire outlet tube out of the slit by the head moved away from the base unless the head is moved farther away from the base with the feed-out station operated in the wire holding mode.

The wire segments of a cable harness are usually divided into a predetermined number of wire segment groups laid on the harness board in different levels. On the other hand, the harness board mentioned above usually has a plurality of wire holders comprising, in turn, wire holder rods, respectively, to be attached to the harness board for guiding the wire segments being laid by the harness laying head on the harness board. In accordance with still another aspect of this invention, each of the wire holders comprises a plurality of level pins attached to the wire holder rod substantially at the levels of the wire segment groups to be guided by the rod and extending parallel to the harness board to which the rod is attached.

BRIEF DESCRIPTION OF THE DRAWING:

FIGS. 6A and 6B schematically show vertical sections of a wire clamper of the machine assembly in different modes of operation, together with a portion of the harness laying head;

FIG. 7 is a schematic vertical sectional view of the clamper taken on a plane represented in FIG. 6B by a line 7—7;

FIG. 19 is a schematic perspective view of a portion of a harness board, a harness laying head, and a head control portion of the machine assembly;

FIG. 20 shows a wire outlet tube assembly of a harness laying head of the machine assembly partly in vertical section; and FIG. 21 is a schematic horizontal sectional view of the wire outlet tube assembly taken on a plane represented in FIG. 20 by a line 21—21.

Figure 1:
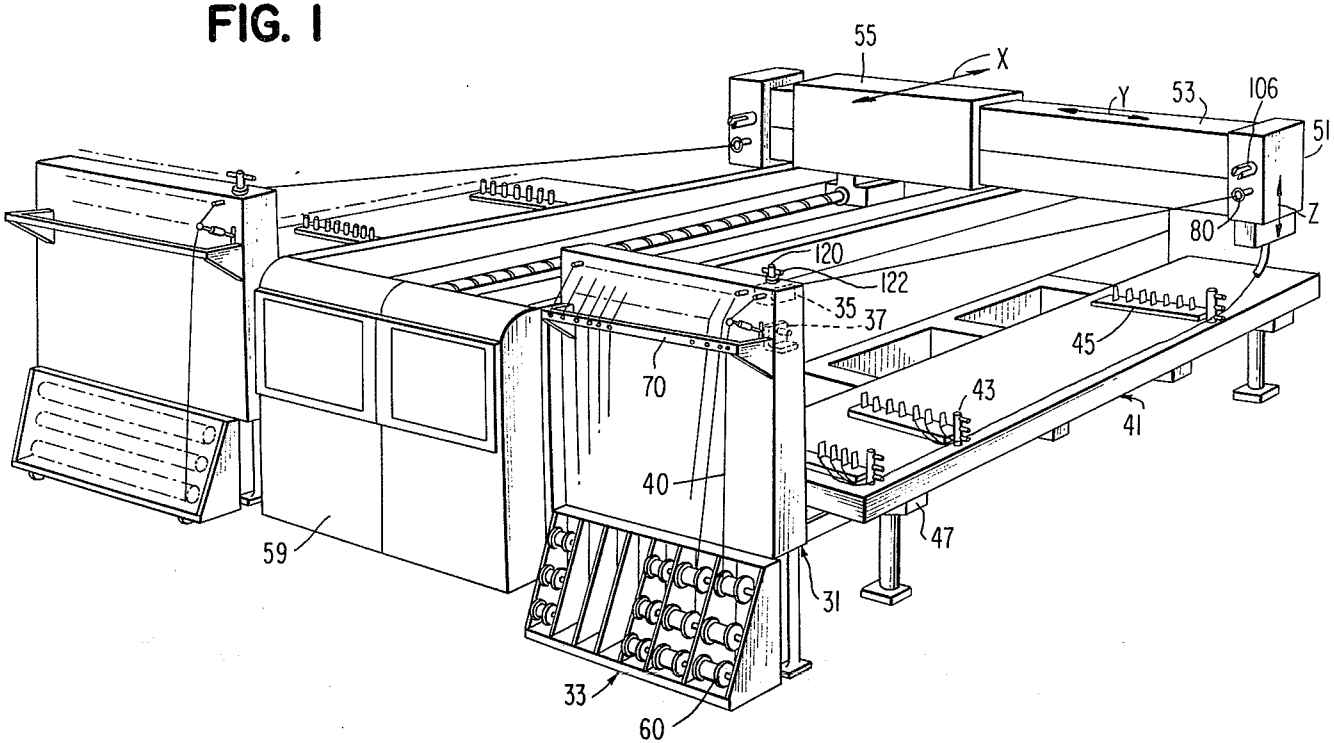
FIG. 1 is a general perspective view of a machine assembly according to a preferred embodiment of the instant invention.

DESCRIPTION OF THE PREFERRED EMBODIMENTS:

Referring to FIG. 1 a numerically controlled machine assembly according to a preferred embodiment of the present invention for automatically forming a cable harness (not shown) comprises a wire supply station 31 including a reel station 33, a plurality of wire supply heads 35, herein called wire clampers, and a plurality of tension sensors 37 interposed between the reel station 33 and the respective clampers 35. As will later be described in detail, a plurality of wires 40 of various gauges and color codes are supplied or dispensed by the reel station 33 and held by the respective clampers 35 with the tension of the wires 40 controlled within a predetermined range by cooperation of the reel station 33 and the tension sensors 37. The machine assembly further comprises a harness board 41 on which the cable harness is to be formed. The harness board 41 has a plurality of wire holders 43 and a plurality of wire end retainers 45 and is replaceably placed, with one end thereof disposed adjacent to the wire supply station 31, on a worktable 47 of the machine assembly well below the wire clampers 35. Although illustrated on a single level, the clampers 35 may be situated on different levels. The machine assembly still further comprises a harness laying or operating head 51 carried by a boom 53 of a carriage 55. In addition, the machine assembly comprises a numerically controlled or otherwise program-controlled unit 59 for moving the operating head 51 through the carriage 55 and boom 51 relative to the wire supply station 31 and harness board 41 in three-dimensional directions X, Y, and Z.

Controlled by the control unit 59, the head 51 is brought at first into adjacency of one of the clampers 35 that holds predetermined one of the wires 40. The head 51 now receives and carries the predetermined wire 40 in the manner later described. Further controlled by the control unit 59, the head 51 moves over and relative to the harness board 41 to lay the predetermined wire 40 along a predetermined route passing by preselected ones of the wire holders 43 and end retainers 45 to form one wiring of the cable harness. Successive movement of the head 51 along respective predetermined routes results in wirings of the predetermined wire 40 in the cable harness. Subsequently, the remaining wires of the cable harness are similarly and successively received by the head 51 and laid thereby on the harness board 41 to eventually form the remaining wirings of the cable harness. Meanwhile, the wires are cut into wire segments of the cable harness. It will be seen that the machine assembly comprises another set of like elements, except the boom 53, the carriage 55, and control unit 59, to enable a pair of like cable harnesses to be simultaneously formed, thereby multiplying production capacity of the machine assembly.

Figure 2:
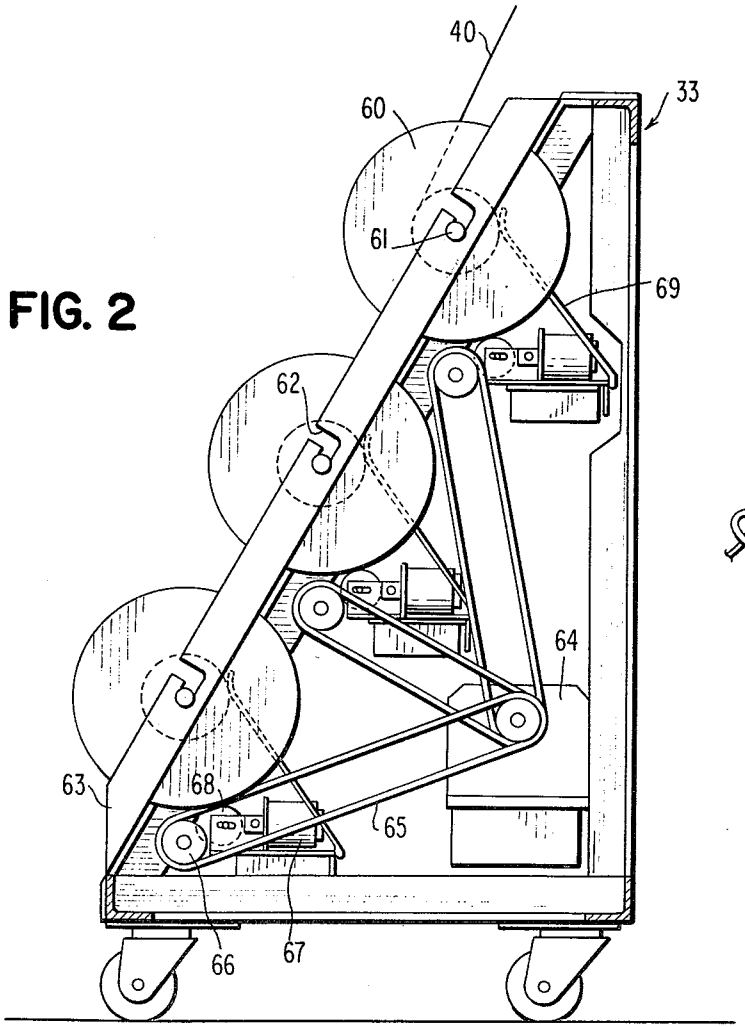
FIG. 2 is a schematic side view of a reel station of the machine assembly.

Referring to FIGS. 1 and 2, the reel station 33 accommodates a plurality (twenty-one, in the example being illustrated) of reels 60 for the respective wires 40. A plurality of reel shafts 61 for the respective reels 60 are removably and rotatably received in L-shaped slots 62 formed in a plurality (eight, in the example being illustrated) of equally or unequally spaced channel beams 63. The reel station 33 comprises an electric motor 64 for simultaneously driving, through endless belts 65, a plurality (three, in the example being illustrated) of drive shafts 66 placed adjacent to the reels 60. In addition, the reel station 33 comprises a plurality of push-type electromagnetic solenoids 67 having plungers for urging, when the solenoids 67 are energized, a plurality of idlers 68 to the drive shafts 66 and the respective reels 60 to make the drive shafts 66 drive the respective reels 60 in a common direction of pulling the wires 40 back from the respective wire clampers 35. As will later be described, that selected one of the solenoids 67 is energized by a first electric signal supplied in the example being illustrated from the associated one of tension sensors 37 which drives the reel 60 for the selected one of the wires 40. The reel station 33 still further comprises a plurality of empty sensor levers 69 brought into contact with the respective outer surfaces of wires wound around the reels 60 so that each of the sensor levers 69 may produce a second electric signal when the wire wound around the associated reel 60 is consumed to a predetermined small amount. The second signal indicates the necessities of interrupting formation of the cable harness and substituting a "full" reel for the "empty" reel.

Figure 3:
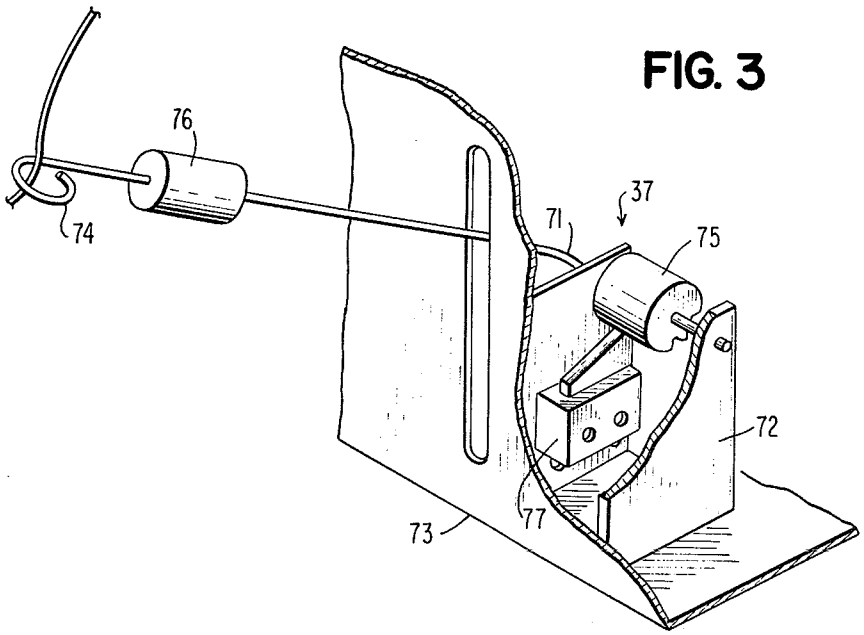
FIG. 3 is a perspective view of a tension sensor of the machine assembly.

Referring to FIGS. 1 and 3, the tension sensor 37 comprises a wire guide 70 (FIG. 1) having a plurality of holes for the respective wires 40 and a sensor arm 71 for each of the wires 40. A bent end of the arm 71 is rockingly supported by a pair of brackets 72 situated within a housing 73 of the wire supply station 31. The other end of the arm 71 is disposed above and adjacent to the wire guide 70 and has a loop 74 for the relevant one of the wires 40. The arm 71 carries a cam 75 between the brackets 72 and a weight 76 adjacent to the loop 74. In addition, the tension sensor 37 comprises a sensor switch 77 operatively coupled to the cam 75. When the tension of the associated wire 40 decreases to a predetermined value, the free end of the arm 71 is lowered by the weight 76 to make the switch 77, operated by the cam 75, produce the first signal mentioned above for setting the associated reel 60 into rotation to take up the relaxation in the relevant wire 40.

Figure 5:
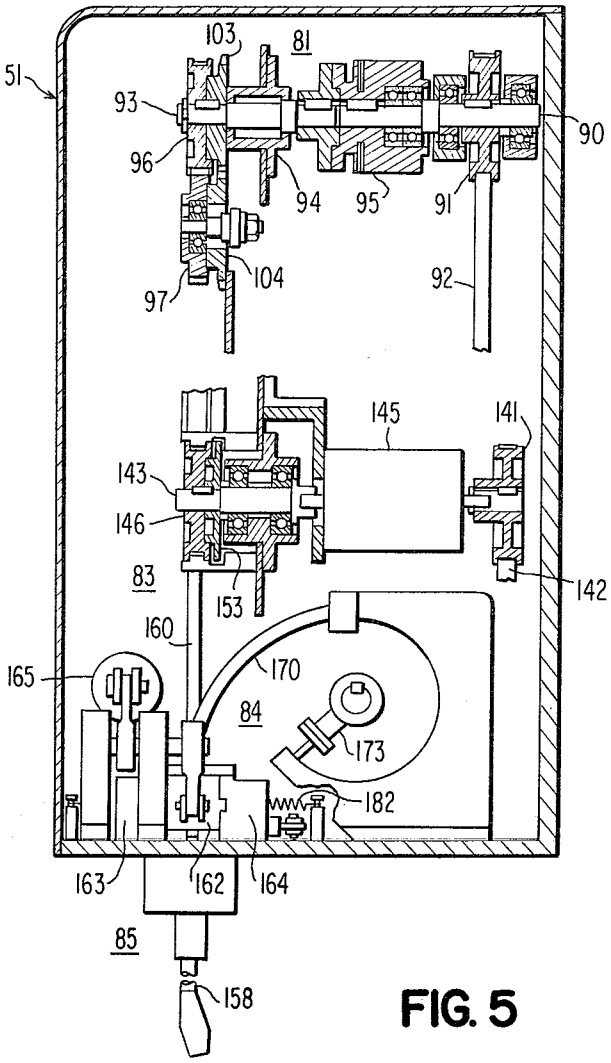
FIG. 5 likewise shows partial sectional views of the head taken on a stepped plane represented in FIG. 4 by lines 5—5.
Figure 4:
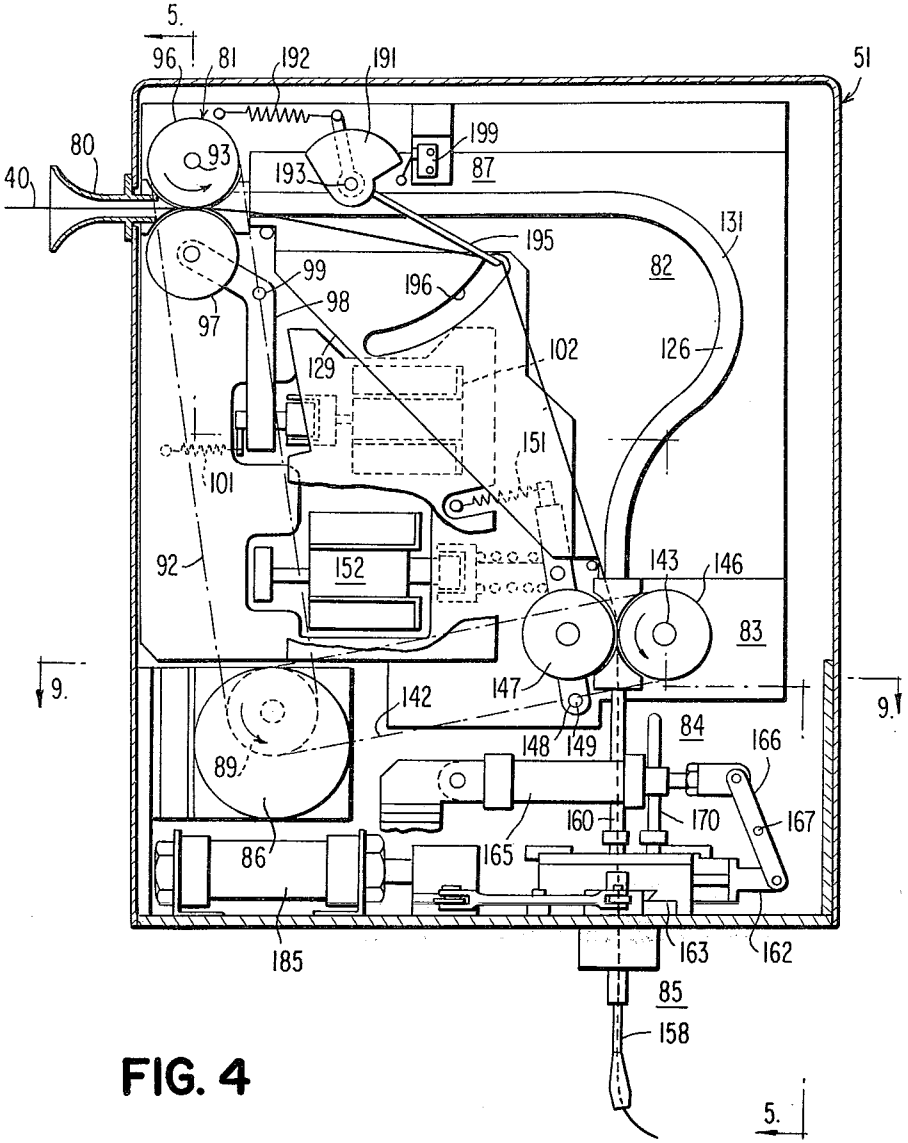
FIG. 4 schematically shows the structure of a harness laying head of the machine assembly.

Referring now to FIGS. 1, 4, and 5, the operating head 51 primarily comprises a wire inlet port 80 for the predetermined one of the wires 40, a wire feed-in station 81, a wire guiding and storing station 82, a wire feed-out station 83, a wire cutting and pushing station 84, a wire outlet port or payout tube 85 for laying the predetermined wire 40 on the harness board 41, and an electric motor 86 for setting the stations 81 through 84 into operation in the manner later described. The head 51 further comprises an additional station 87 for detecting the amount of the wire 40 stored in the wire storing station 82. A pulley 89 is directly driven by the shaft of the motor 86 for the purposes detailed hereunder.

Further referring to FIGS. 1, 4, and 5, the wire feed-in station 81 comprises a primary shaft 90 (FIG. 5) driven by the motor 86 through a pulley 91 and an endless belt 92 operatively coupling the pulley 91 with the pulley 89, a secondary shaft 93 unidirectionally rotatably supported by a bearing 94 and driven by the primary shaft 90 through an electromagnetic clutch 95, a first capsan 96 keyed to the secondary shaft 93, and a second capstan 97 rotatably carried by a bell crank 98 (FIG. 4) pivotted at 99. The bell crank 98 is biased clockwise in FIG. 4 by a tension coil spring 101 away from the first capstan 96 and pulled by a pull-type electromagnetic solenoid 102 against the action of the tension spring 101. The capstans 96 and 97 are accompanied by integral spur gears 103 and 104 (FIG. 5) capable of meshing with each other.

In a free mode of operation where the clutch 95 and solenoid 102 are deenergized and energized, respectively, the capstans 96 and 97 leave an appreciable gap therebetween and are not driven by the motor 86. The feed-in station therefore allows the free end of the wire 40 to be received by the operating head 51 between the capstans 96 and 97 and allows the wire 40 to be pulled into the head 51 or relatively away therefrom. In an active mode of operation where the clutch 95 and solenoid 102 are energized and de-energized, respectively, the second capstan 97 is urged to the first capstan 96 with the gears 103 and 104 brought into the meshing relationship. In addition, the capstans 96 and 97 are driven by the motor 86. The feed-in station 81 thus feeds the wire 40 placed between the capstans 96 and 97 into the head 51. In a passive mode of operation where the clutch 95 and solenoid 102 are both energized, the second capstan 97 is urged to the first capstan 96. The capstans 96 and 97, however, are neither driven by the motor 85 nor turned in the opposite direction because of the unidirectionally rotatable support by the bearing 94. The feed-in station 81 is therefore adapted for suspension of the wire feed and allows the wire 40 to be pulled into the head 51 by the feed-out station 83 in the manner later described.

Referring to FIGS. 1, 6A, 6B, and 7, the operating head 51 comprises a pair of forks 106 above the wire inlet port 80, protruding towards the wire supply station 31 and having a pair of similarly tapered ends 107. On the other hand, each of the wire clampers 35 comprises a horizontal tube 110 (FIGS. 6A, 6B, and 7) for the relevant one of the wires 40 horizontally slidably relative to the wire supply station housing 73. The tube 110 has an opening in the longitudinally central portion, to which a pair of brackets 111 is coupled. The brackets 111 are urged by a compression coil spring 112 forwardly towards the operating head 51 and have a pair of likewise sloped edges 113 and a pair of horizontal edges 114 forming a pair of steps therebetween. A wire press rod 116 is pivotally supported by the brackets 111 at 117 and has an end urged clockwise in FIGS. 6A and 6B by a torsion coil spring 118 to press the wire 40 against the inside surface of the tube 110. A protrusion 119 extends parallel to the wire supply station housing 73 above the tube 110 and knocks the wire press rod 116 counterclockwise to put its end out of contact with the tube inside surface in the manner depicted in FIG. 6B when the brackets 111 are moved, together with the tube 110, forwardly towards the operating head 51 by the compression spring 112. The clamper 35 further comprises a vertically slidable shaft 120 urged downwards by a compression coil spring 121 and having a latch release pin 122 at its upper end for engagement with the tapered ends 107 of the operating head forks 106 and a latching pin 123 at its lower end capable of engaging in the manner illustrated in FIG. 6A with the steps formed between the bracket sloped and horizontal edges 113 and 114 to latch the brackets 111, together with the tube 110, against the action of the compression spring 112.

Further referring to FIGS. 1, 4, 5, 6A, 6B, and 7, the wires 40 are put through the respective clamper horizontal tubes 110 put in the positions exemplified in FIG. 6B to extend nearly a predetermined length forwardly of the tube 110 towards the operating head 51. subsequently, the tubes 110 are manually pushed away from the head 51 against the action of the compression springs 112 for the brackets 111 so that the latching pins 123 may slide along the bracket sloped edges 113 and then latch the tubes 110 and brackets 111 with the wire press rods 116 rocked by the torsion springs 118 to clamp the relevant ones of the wires 40. When the operating head 51 with its feed-in station 81 put in the free or active mode of operation under the control of the control unit 59 in the manner later described is brought near to that one of the clampers 35 also under the control of the control unit 59 in the known manner which holds predetermined one of the wires 40 so that the wire inlet port 80 of the former may be in approximate alignment with the horizontal tube 110 of the latter, the forks 106 of the former release the latching pin 123 of the latter from engagement with the bracket steps to render the tube 110 urged against the inlet port 80 by the compression spring 112 in the manner exemplified in FIG. 6B. It will be noticed that the wire inlet port 80 is outwardly flared so as to receive the clamper horizontal tube 110. Alternatively, those ends of the horizontal tubes 110 which are directed towards the operating head 51 may be outwardly flared to receive the wire inlet port 80 brought adjacent thereto. It will be appreciated that the free end of the selected one of the wires 40 is placed between the capstans 96 and 97.

Figure 8B:
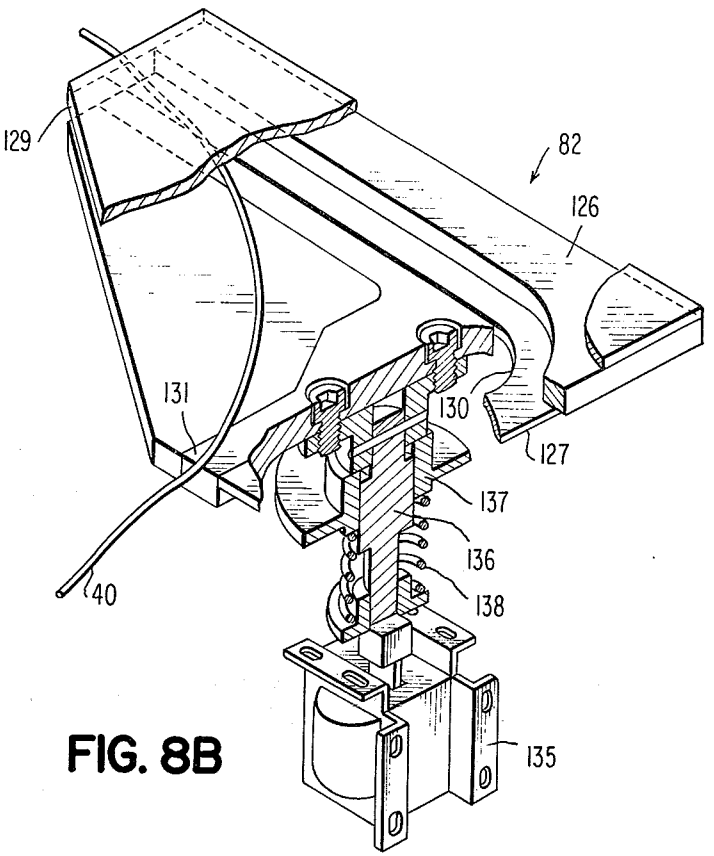
FIGS. 8A and 8B show partially cut away perspective views of a wire guiding and storing station of the harness laying head.
Figure 8A:
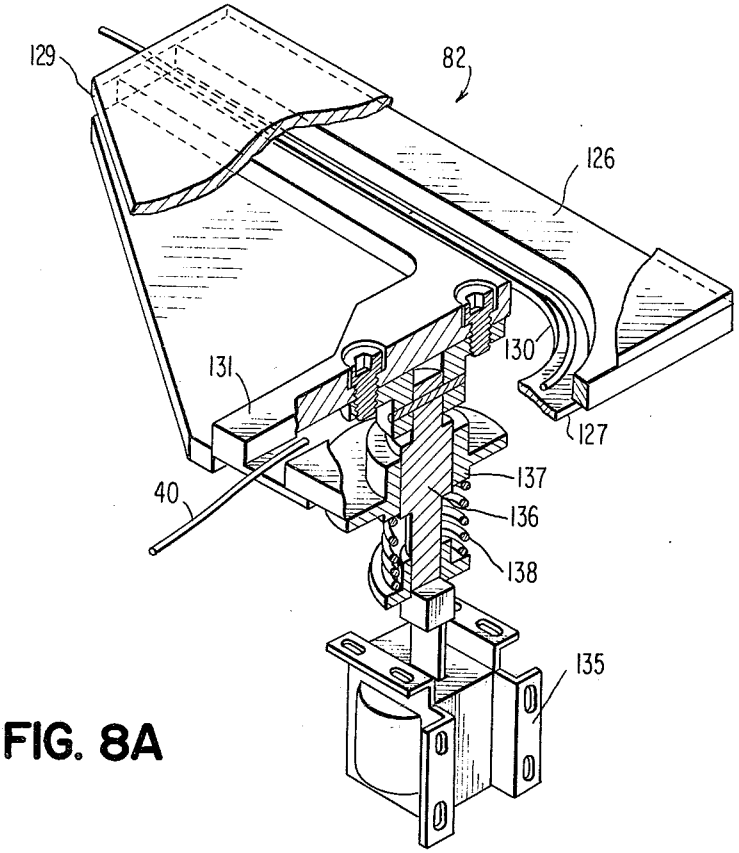

Referring back to FIG. 4 and afresh to FIGS. 8A and 8B, the wire guiding and storing station 82 comprises a first guide 126 fixed relative to the operating head 51 and comprising, in turn, a first end adjacent to the capstans 96 and 97 and inwardly projecting ridge 127 (FIGS. 8A and 8B) that is offset with respect to the free end of the wire 40 placed between the capstans 96 and 97 to leave a space between the ridge side surface and a substantially transparent plate 129 brought into contact with the first guide side surface and has an outwardly directed edge surface extending from the first end along a curved line 130. The station 82 further comprises a second guide 131 movable sidewise of the first guide 126 (perpendicularly of the plane of FIG. 4) and comprising, in turn, a first end adjacent to the capstans 96 and 97 and an outwardly directed surface extending from the second guide first end along the curved line 130. In addition, the station 82 comprises a push-type electromagnetic solenoid 135 (FIGS. 8A and 8B) whose plunger is movable sideway of the first guide 126 and is connected to a driving shaft 136 that is perpendicularly attached to the second guide 131 and axially slidably supported by a bearing 137 fixed relative to the head 51. A compression coil spring 138 urges the driving shaft 136 sidewise away from the first guide 126. In a wire guiding mode of operation where the solenoid 135 is energized, the second guide 131 is pushed against the transparent plate 129 in the manner illustrated in FIG. 8A to leave a narrow space defined by the transparent plate 129 and the first and second guides 126 and 131. The wire 40 may therefore be fed by the feed-in station 81 put in the active mode through the narrow space. In a wire storing mode of operation where the storing station solenoid 135 is de-energized, the second guide 131 is pulled away from the transparent plate 129 so that its side surface may become flush with the side surface of the first guide inwardly projecting ridge 127 as shown in FIG. 8B to leave a wide space between the transparent plate 129 and the common side surfaces of the inwardly projecting ridge 127 and the second guide 131 for storing the fed-in wire 40.

Further referring to FIGS. 4 and 5, the feed-out station 83 comprises a primary shaft driven by the motor through a pulley 141 (FIG. 5) and an endless belt 142 operatively coupling the pulley 141 with the pulley 89, a secondary shaft 143 rotatably supported by a bearing and drivable by the primary shaft through an electromagnetic clutch 145, a feed-out station first capstan 146 keyed to the secondary shaft 143, and a feed-out station second capstan 147 (FIG. 4) rotatably carried by a lever 148 pivotted at 149. The extension of the curved line 130 is tangential to the first capstan 146. The clutch 145 is capable here of transmitting the torque from the primary shaft to the secondary shaft 143, preventing rotation of the secondary shaft 143, and setting the secondary shaft 143 free. The lever 148 is biased anticlockwise in FIG. 4 by a tension coil spring 151 away from the first capstan 146 and capable of being pushed by a push-type electromagnetic solenoid 152 against the action of the tension spring 151. The capstans 146 and 147 are rotatable with the speed of the feed-in station capstans 96 and 97 and accompanied by a first integral spur gear 153 and a second integral spur gear (not shown), respectively, capable of meshing with each other.

In a wire passage mode of operation where the clutch 145 sets the secondary shaft 143 free and the solenoid 152 is deenergized, the capstans 146 and 147 leave an appreciable gap therebetween and are freely rotatable. The feed-out station 83 therefore allows the wire 40 fed thereto by the feed-in station 81 to pass freely between the capstans 146 and 147, as required on receiving the free end of the wire 40 in the feed-out station 83, on laying the wire 40 on the harness board 41, and on letting the wire 40 pulled back to the wire supply station 31. In a wire driving mode of operation where the clutch 145 transmits the torque to the secondary shaft 143 and the solenoid 152 is energized, the second capstan 147 is urged to the first capstan 146. In addition, the capstans 146 and 147 are driven by the motor 86 to forcibly feed the wire 40 towards the wire outlet port 85. In a wire holding mode of operation where the clutch 145 prevents rotation of the secondary shaft 143 and the solenoid 152 is energized, the capstans 146 and 147 are brought into the mutually urged relationship but are not rotatable. The feed-out station 83 thus immovably holds the wire 40, as required on cutting the wire at the cutting and pushing station 84.

Figure 10:
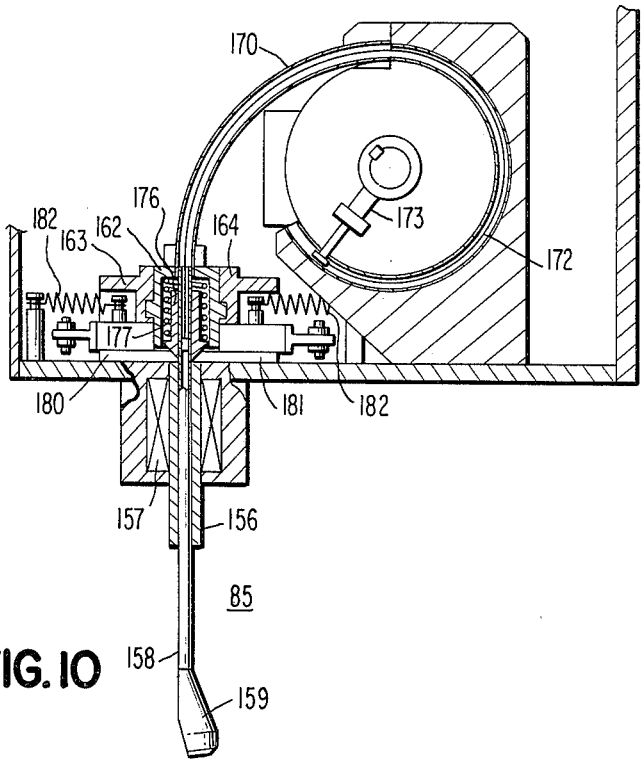
FIG. 10 is a schematic partial vertical sectional view of the head taken on a plane represented in FIG. 9 by a line 10—10.

Referring again to FIGS. 4 and 5 and at first to FIG. 10, the wire outlet port 85 comprises a supporting pipe 156 rotatably held by a bearing 157 and a wire tube 158 having a slightly bent tip 159 and replaceably supported by the supporting pipe 156. The wire tube tip 159 is freely directed to the direction of the wire 40 being laid on the harness board 41 to allow smooth feed of the wire 40 through the outlet port 85.

Figure 9:
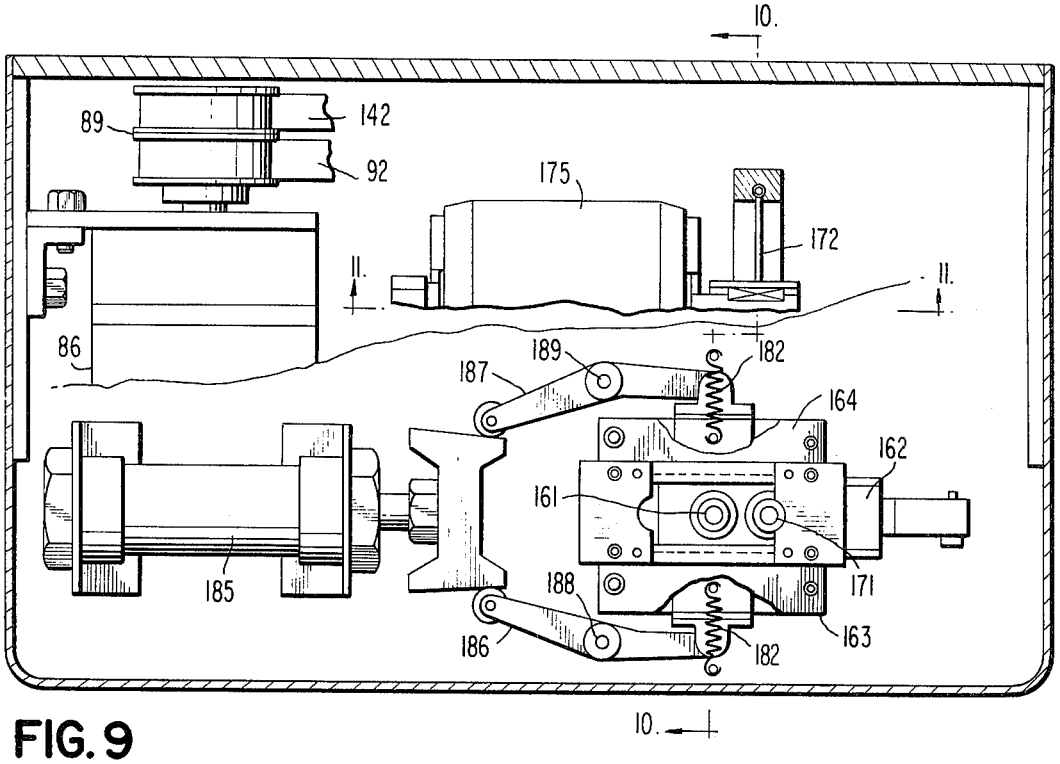
FIG. 9 is a schematic horizontal sectional view of the harness laying head taken on a plane represented in FIG. 4 by a line 9—9.
Figure 11:
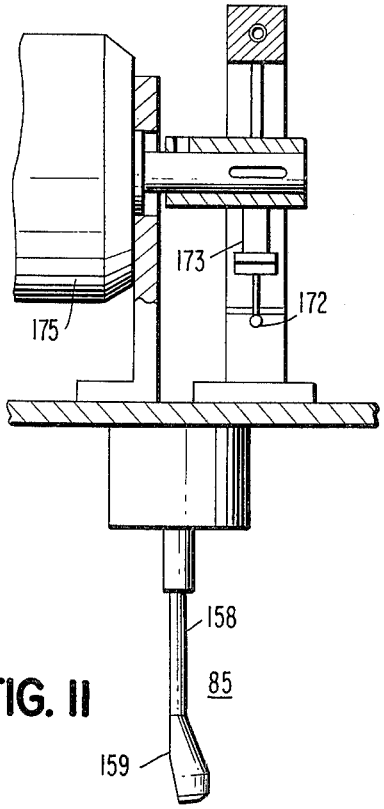
FIG. 11 is a similar view of the head taken on a plane shown in FIG. 9 by a line 11—11.

Referring once again to FIGS. 4, 5, and 10 and afresh to FIGS. 9 and 11, the wire cutting and pushing station 84 comprises a flexible wire guide pipe 160 (FIGS. 4 and 5) having a first end disposed approximately tangential to the feed-out station first capstan 146. The other end of the guide pipe 160 is put through a first hole 161 (FIG. 9) formed through a sliding member 162, which is slidably held between a pair of fixed guides 163 and 164 and driven by a reciprocating piston of a first air cylinder 165 through a rocking lever 166 at 167 (FIG. 4). In addition, the cutting and pushing station 84 comprises a flexible pusher guide pipe 170 having a fixed end and a free end that is put through a second hole 171 formed through the sliding member 162. Actuated by the air cylinder 165, the sliding member 162 places either of the wire and pusher guide pipes 160 and 170 in alignment with the wire tube 158 of the wire outlet port 85. The pusher guide pipe 170 slidably ensheaths a flexible pusher 172 (FIGS. 10 and 11) that extends arcuately beyond the fixed end of the guide pipe 170 and fixed to a rotatable driver 173 driven by a second air cylinder 175. When driven counterclockwise (FIG. 10) the pusher 172 extends into the wire output port tube 158. Preferably, the free ends of the guide pipes 160 and 170 are connected to pipe connectors, such as 176 (FIG. 10), disposed in the respective holes 161 and 171 and urged towards the outlet port 85 by compression coil springs, such as 177. The cutting and pushing station 84 further comprises a pair of cutters 180 and 181 (FIG. 10) disposed slidably in dovetail grooves formed into the fixed guides 163 and 164 adjacent to the outlet port 85. The cutters 180 and 181 are normally biased by a pair of tension coil springs 182 and 183 away from the extension of the wire output port tube 158 into their inoperative positions and may be pushed inwards into their operative positions by a reciprocating piston of a third air cylinder 185 through a pair of bell cranks 186 and 187 pivoted at 188 and 189. In a wire freeing mode of operation where the wire guide pipe 160 is brought into alignment with the wire outlet port tube 158 and the cutters 180 and 181 are put in their inoperative positions, the wire may be fed by either or both of the feed-in and feed-out capstan pairs continually through the wire outlet port 85. In a wire cutting mode of operation where the feed-out station 83 is put into the holding mode and the cutters 180 and 181 are put into their operative positions, it is possible to cut the wire 40. In a wire pushing mode of operation where the pusher guide pipe 170 is aligned with the wire outlet port tube 158, the free end of the pusher 172 may be pushed towards into the tube 158 subsequent to the cutting mode of operation to push the trailing end of the wire 40 out of the outlet port 85.

Still further referring to FIGS. 4 and 8, the wire amount detection station 87 comprises a cam 191 biased by a tension coil spring 192 around a pivot 193 and having an integral detection rod 195 whose end is bent perpendicularly of the plane of FIG. 4 into an arcuate groove 196 formed through the transparent plate 129. In addition, a limit switch 199 is operatively coupled to the cam 191. When the amount of the wire 40 stored in the wire guiding and storing station 82 in its storing mode of operation decreases to a predetermined minimum amount, the wire 40 turns the detection rod 195 clockwise in FIG. 4 so that the cam 191 may render the limit switch 199 energized.

Figure 12:
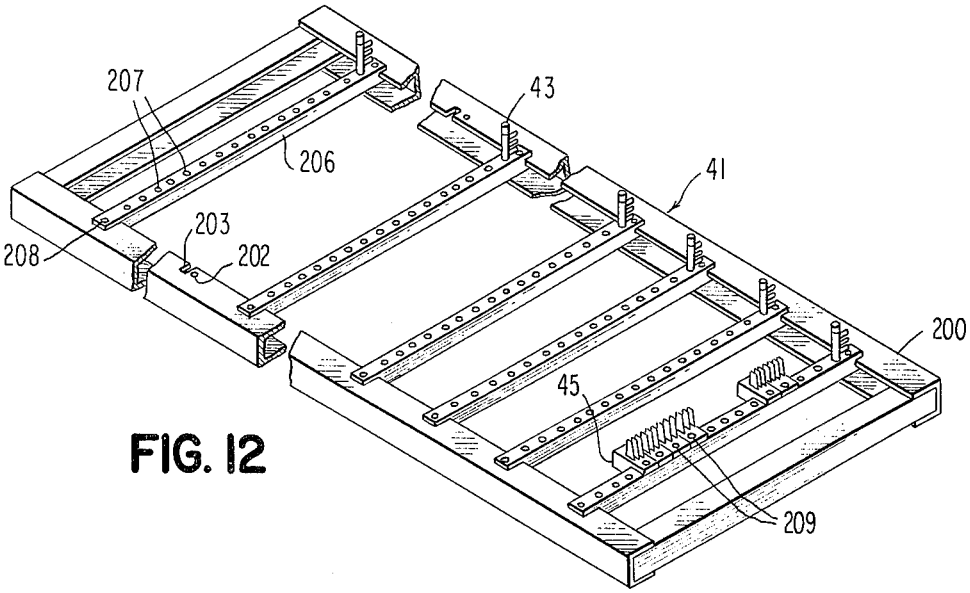
FIG. 12 is a schematic perspective view of a harness board of the machine assembly.

Referring now to FIGS. 1 and 12, a harness board 41 may comprise a framework 200 having a plurality of holes 202 and slots 203 and a plurality of transverse members 206 having a plurality of holes 207 and adjustably fixed to the fremework 200 by means of machine screws 208 or by any other means. The framework 200 may be made of channel beams of an aluminium alloy. The transverse members 206 may be angle beams of a like material. The slots 203 serve to position the transverse members 206. The holes 202 and 207 may be threaded. The wire holders 43 and wire end retainers 45 may be removably fixed to the transverse members 206 by means of machine screws 209 or by any other means. In the example being illustrated, the transverse members 206, the wire holders 43, and the wire end retainers 45 are positioned preliminarily in accordance with the cable harness pattern.

Figure 13:
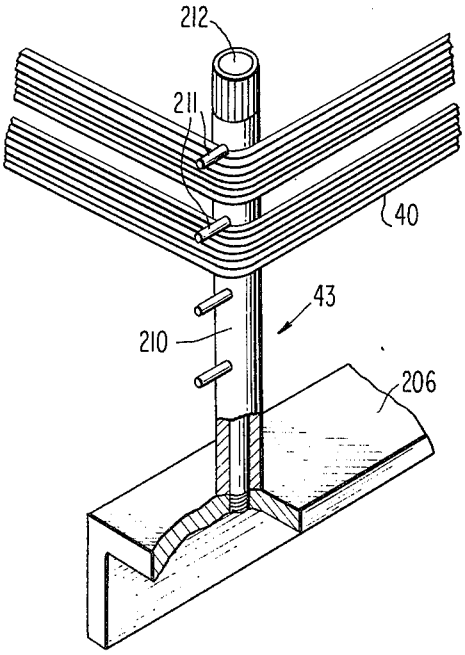
FIG. 13 is a greatly enlarged perspective view of a wire holder of the machine assembly.

Referring to FIG. 13, a wire holder 43 comprises a hollow cylinder 210, a plurality of level pins 211 fixed to the cylinder 210 at various levels, and a long shank machine screw 212 for removably attaching the wire holder 41 to the transverse member 206. The number of the level pins 211 and the spacings therebetween are determined by the number of wire levels in the cable harness and the distances therebetween.

Figure 14:
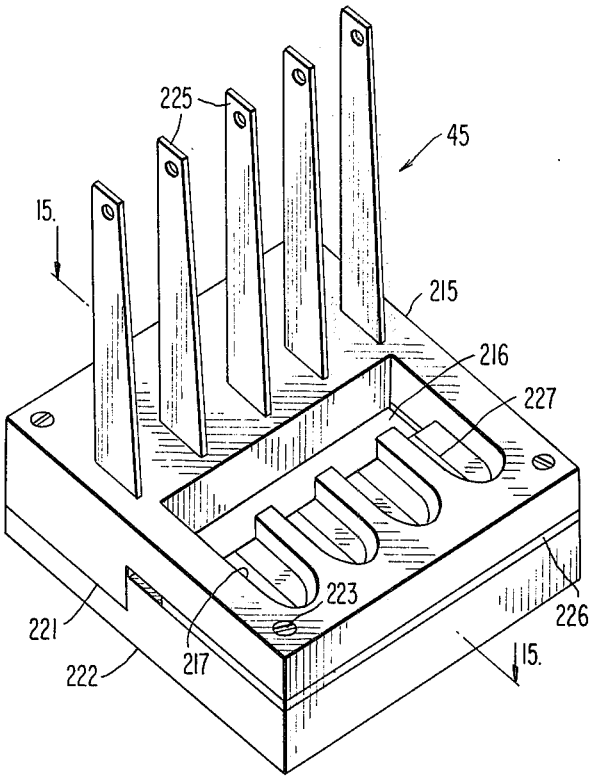
FIG. 14 schematically shows a like view of a wire end retainer of the machine assembly.

Referring to FIG. 14, a wire end retainer 45 may comprise a base 215 having an elongated main hole 216 and a plurality of branch holes 217 formed therethrough. The branch holes 217 extend from the main hole 216 to one side thereof and have a width allowing the wire outlet port tube 158 to be freely put into the substantial portion of each branch hole 217. The base 215 comprises a first member 221 and a second member 222 fixed to the first member 221 by means of machine screws 223 or by any other means. The retainer 45 further comprises a plurality of wire twig rods 225 attached to the first member 221 on the other side of the main hole 216 and a wire end retainer sheet 226 of a resilient material, such as neoplene rubber, interposed between the first and second members 221 and 222 and provided with a plurality of slits 227 that extend from the main hole 216 into the respective branch holes 217. The twig rods 225 are spaced in accordance with the distances between the wire end twigs of the cable harness. The retainer 45 is attached to the transverse member 206 with the twig rods 225 aligned with at least one of the wire holders 43.

Figure 15A:
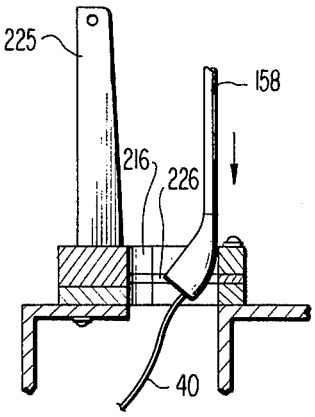
FIGS. 15A, 15B and 15C show schematic side views of the wire end retainer taken on a plane represented in FIG. 14 by a line 15—15, for describing the operation of the wire end retainer.
Figure 15B:
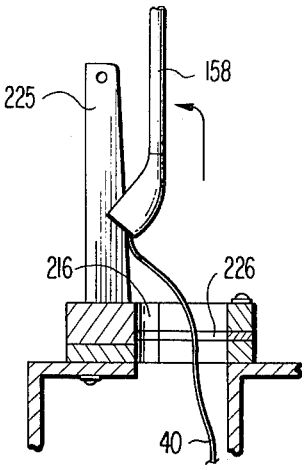
Figure 15C:
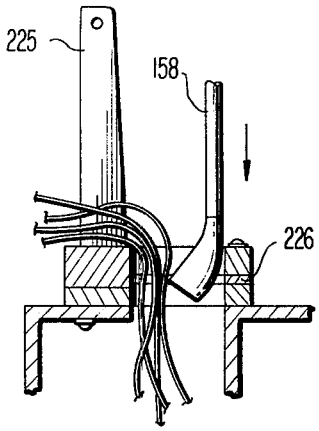

Referring to FIGS. 14 and 15, the wire outlet port tube 158 is put down into the selected one of the branch holes 217 as shown in FIG. 15A. Subsequently, the wire 40 held by the operating head 51 is positively fed out by the feed-out capstans 146 and 147 in the manner also depicted in FIG. 15A. As illustrated in FIG. 15B, the operating head 51 is now moved upwards and towards the space between selected one of the twig rods 225 and that one of the rods 225 which is next adjacent to the selected twig rod 225 on its side remote from the associated wire holder or holders 43. The free end of the wire 40 is retained in the slit 227 of the retainer sheet 226 as a result of friction imposed thereon by the retainer sheet 226. When at least one wire 40 is already held by the retainer 45, the wire or wires 40 are pushed aside into the main hole 216 by the down-coming wire outlet port tube 158 as shown in FIG. 15C. The slit 227 of the retainer sheet 226 therefore retains another wire (not shown) through the operation illustrated with reference to FIGS. 15A and 15B. It should be noted that the branch holes 217 need not be in exact correspondence to the wire twig rods 225.

Figure 16:
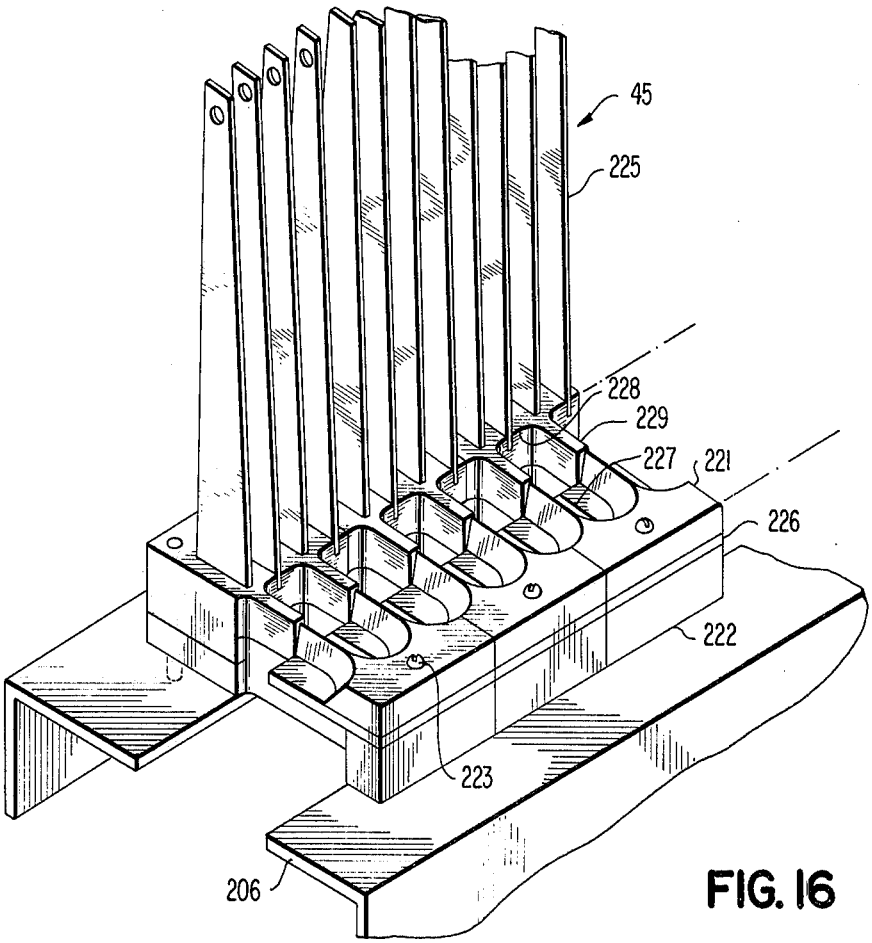
FIG. 16 is a greatly enlarged schematic perspective view of a modified wire end retainer of the machine assembly.

Referring to FIG. 16, another example of the wire end retainer 45 is specifically designed for a crossbar switchboard cable harness along the lines disclosed with reference to FIGS. 14 and 15. A branch of the cable harness may comprise only one twig. The branch, however, usually comprises as many as several scores of twigs spaced by about 6.5 mm as mentioned in the preamble of the instant specification. The wires generally used in the cable harness are from 1.0 mm to 1.3 mm in diameter. The wires 40 may often be twisted wires and may have a larger diameter, such as 3.0 mm. The wire outlet port tube 158 should therefore has an inside diameter of about 4.0 mm and a wall thickness of about 0.5 mm so that the whole diameter of the tube 158 amounts to 5.0 mm. Under such circumstances, the retainer 45 comprises the first member 221 of a width of 26 mm and having a hole 228, wider than 5.0 mm, defined by a pair of bridges 229 and four twig rods or plates 225 aligned with a pitch of 6.5 mm. Each rod 225 may be made of a resilient steel sheet (SK 5) whose thickness is 1.0 mm. The gaps between the adjacent twig rods 225 therefore allows free passage therethrough of the wire outlet port tube 158. The retainer sheet 226 is made of a neoplene rubber sheet, 1.6 mm thick, of the hardness of 60°. The bridges 229 serve to provide sufficient friction to the wire 40 inserted in the slit 227. The first member 221 may be provided with a plurality of straight grooves (not shown) into which arcuately deformed bottom ends (not shown) of the respective twig sheets 225 may be forced. The retainer 45 may be used in contiguous succession as shown in FIGS. 12 and 16. It will readily be understood that the individual holes 228 serves as the main and branch holes illustrated with reference to FIGS. 14 and 15.

For convenience of further description of the machine assembly, general description will be made here of the operation of the machine. At first, a plurality of reels 60 having those wires 40 wound therearound are placed in the reel station 33, which are required to form a desired cable harness. The wires 40 are manually dispensed from the respective reels 60, put through the respective holes of the wire guide 70, the respective loops 74 of the tension sensors 37, and the respective horizontal tubes 330 of the wire clampers 35 with the free wire ends protruded about 50 mm from the horizontal tube forward ends, and clamped by the clampers 35 in the manner already described with reference to FIGS. 1, 4, 5, 6A, 6B, and 7. Meanwhile, a harness board 41 having wire holders 43 and wire end retainers 45 attached thereto in conformity with the pattern of the desired cable harness is placed on the work table 47. Also, the control unit 59 is equipped with a programmed tape (not shown) that stores a program for the desired cable harness. In addition, the harness laying head 51 is placed at a zero position predetermined relative to the harness board 41. The machine assembly is now ready for automatic formation of the desired cable harness.

In compliance with a first block of the program specifying a first one of the wires 40 to be used for several wire segments of the cable harness, head control means of the control unit 59 moves the head 51 adjacent to the wire clamper 35 for the first wire 40 so that the head 51 may receive the wire 40 in the feed-in station 81 in the manner also described above. It may be mentioned here that the head control means, as called herein, may include the boom 53 and carriage 55. Prior to reception of the wire 40 in the feed-in station 81, receive and control means of the head control means including the clutch 95 and solenoids 102 and 135 may put the feed-in station 81 and the guiding and storing station 82 in their respective active and guiding modes of operation. In the meantime, feed-out station control means of the head control means including the clutch 145 and solenoid 152 may put the feed-out station 83 in its driving mode of operation. Also, cut and push control means of the head control means including the air cylinders 165, 175, and 185 may put the cutting and pushing station 84 in its freeing mode. Alternatively, the related means may put the feed-in and feed-out stations 81 and 83 in their respective free and passage modes. In the latter case, the feed-in and feed-out stations 81 and 83 should be put into the active and driving modes after reception of the wire 40 and kept in these modes for a predetermined duration. The first wire 40 is fed through the wire outlet port 85 approximately a predetermined length.

In response to a second block of the program, the feed-in, guiding and storing, and feed-out stations 81 through 83 are switched to the passive, storing, and holding modes of operation. The cutting and pushing station 84 is subsequently switched to the cutting mode to cut the wire 40 into a wire section having a trailing end therein and passing through the outlet port 85 and a remainder held by the feed-out station 83 and continuing to the wire supply station 31 and thereafter into the pushing mode to push the trailing end out of the outlet port 85. The cutting and pushing station 84 is now switched back to the freeing mode. These processes are desired to achieve a correct skinner length for the leading end of the first wire segment to be laid of the first wire 40.

The head control means moves the head 51 in accordance with a third block of the program above that one of the slits 227 of the wire end retainer 45 which is selected for the leading end of the first wire segment and subsequently lowers the head 51 in compliance with a fourth block of the program down to the selected slit 227. Also, the feed-out station control means puts the feed-out station 83 in the driving mode for a time predetermined in connection with the first wire segment leading end to feed a predetermined length of the wire 40 into the selected slit 227. After the predetermined time, the feed-out station 83 is returned to the holding mode. The head control means lifts the head 51 a predetermined amount in compliance with a fifth block of the program to place the wire outlet port tube tip 159 on the wire level of the first wire segment. The feed-out station control means returns the feed-out station 83 to the passage mode.

In response to the subsequent blocks of the program, the head 51 is moved along the wire route and wire level of the first wire segment with the feed-in, guiding and storing, feed-out, and cutting and pushing stations 81 through 84 kept at least at first in the passive, storing, passage, and freeing modes. At the start of the wire route, the wire outlet port tube 158 passes between two wire twig rods 225 placed adjacent to the selected slit 227. Eventually, the head 51 comes to a standstill above a relevant wire end retainer slit 227 after the outlet port tube 158 passed between the adjacent twig rods 225.

Either while the feed-out station 83 drives an appreciable length of the wire 40 to provide the wire segment leading end or while the head 51 runs away from the wire supply station 31 during a considerable time interval, the length of the wire 40 stored in the guiding and storing station 82 may decrease to the predetermined minimum amount. The feed-in station 81 is switched in the manner later described into the active mode to supplement the wire 40 in the guiding and storing station 82. On the other hand, the head 51 may run towards the supply station 31 during its movement along the wire route so that relaxation may occur in that portion of the wire 40 which extends between the supply station 31 and the feed-in station 81. As soon as the tension in the wire portion decreases to the predetermined value, the associated tension sensor 37 sets the pertinent solenoid 67 into operation in the reel station 33 to make the relevant reel 60 take up the relaxation in the manner already described. It has now been found that the preferred tension given to the wire being manually laid along a straight wire route is only 200 grams and that the wire is bent by finger tips at each bend of a wire route. These complicated processes are hardly realizable with conventional automatic cable harness forming machines. In addition, the desired tension will not be insured throughout a wire route without a specific scheme because the head 51 moves towards the supply station 31 at times and away therefrom in other times. The tension also varies when a decrease is notable in the wire 40 remaining around the reel 60. It has, however, been found that a machine assembly according to this invention gives the best results when the tension in the wire 40 being laid along a wire route is kept between 400 and 800 grams and when the feed-out station 83 is operated in the passage mode with the tension in the wire stored in the guiding and storing station 82 kept substantially at zero and with the tension in the wire 40 beyond the outlet port tube tip 159 given by the friction between the outlet port tube 158 and the wire 40, when the latter tension is kept at about 400 grams despite inevitable normal changes in the head velocity and between 400 and 800 grams even when a sudden change may occur in the head velocity as, for example, when the head 51 is accelerated from a standstill to full speed within one second. In this connection, it may be mentioned here that the feed-in or feed-out station 81 or 83 feeds the wire 40 at a speed substantially equal to the highest speed of the head 51 moving along a wire route.

Returning to description of operation, the head 51 is now lowered in compliance with a next subsequent block of the program until the outlet port tube tip 159 is put into the relevant wire end retainer slit 227. The feed-out station 83 is switched to the driving mode for a predetermined duration and thereafter to the holding mode. The cutting and pushing station 84 is successively switched to the cutting, pushing, and freeing modes. The trailing end of the first wire segment is now retained by the relevant slit 227.

The above-mentioned processes are repeated for a second wire segment and the remaining wire segments formed of the first wire.

In accordance with a next following block of program, the head 51 is moved upwards to the highest level and subsequently adjacent to the wire clamper 35 for the first wire 40. The feed-in and feed-out stations 81 and 83 are switched to the free and passage modes. The tension in the wire 40 now decreases to zero, with the result that the wire 40 is taken up by the reel 60 therefor. The feed-in and the guiding and storing stations 81 and 83 are switched to the active and guiding modes. Alternatively, the former may be kept in the free mode. The feed-out and the cutting and pushing stations 83 and 84 are switched to the driving and freeing modes. Alternatively, the feed-out station 83 may be left in the passage mode. The machine assembly is thus ready for formation of a first wire segment and other wire segments of a second wire.

Figure 17:
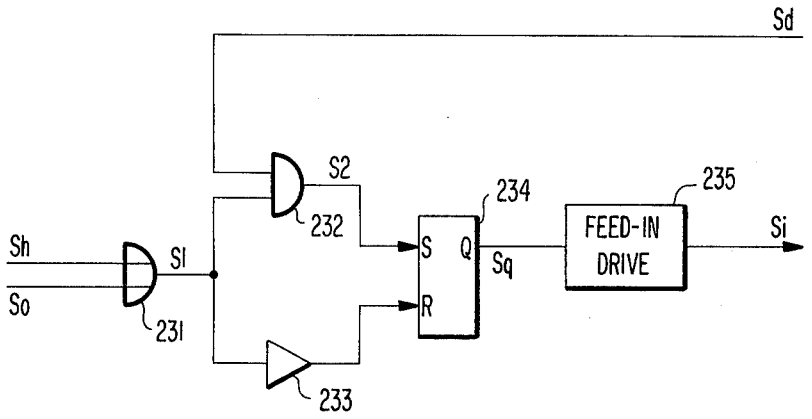
FIG. 17 shows a block circuit diagram of a portion of a control unit of the machine assembly.

Reference is now had to FIG. 17. Receive control means of the receive and store control means comprises the clutch 95 and solenoid 102 in the head 51 and a receive control circuit in the control unit 59. The receive control circuit comprises an OR gate 231 for producing a first gate output signal S1 in response to one or both of a head horizontal drive signal Sh for horizontally driving the head 51 and a feed-out signal So for putting the feed-out station 83 in its wire driving mode. It will be understood that the head control means produces various head drive signals, such as Sh, for driving the head 51 in various directions and that the feed-out station control means produces the feed-out signal So for operating the feed-out station 83 in the driving mode. The receive control circuit further comprises an AND gate 232 responsive to the first gate output signal S1 and a detection signal Sd resulting from energization of the limit switch 199 in the guiding and storing station 82 for producing a second gate output signal S2, an inverter 233 for the first gate output signal S1, a flip-flop circuit 234 set by the second gate output signal S2 for producing a Q output signal Sq and reset by the inverted first gate output signal S1, and a driving circuit 235 responsive to the Q output signal Sq for producing a feed-in signal Si for putting the feed-in station 81 in the active mode. In the absence of the feed-in signal Si, the feed-in station 81 may be put in the free or passive modes.

It will readily be appreciated that the feed-in station 81 is switched to the active mode as soon as the limit switch 199 produces the detection signal Sd either while the head 51 lays each wire segment on the harness board 41 or while the feed-out station 83 drives a length of the wire 40 to form the leading and/or trailing end of each wire segment. When the detection signal Sd is produced after the head 51 is accelerated to the highest speed, the amount of the wire 40 stored in the guiding and storing station 82 comes to a substantially steady state with the amount kept somewhat smaller than the predetermined value. When the detection signal Sd is produced while the head 51 is being accelerated from a standstill to the highest speed, the amount of the wire 40 fed into the guiding and storing station 82 exceeds the amount driven therefrom until the head 51 reaches the full speed. The amount of the wire 40 stored in the guiding and storing station 82 therefore comes to a substantially steady state with this amount remaining somewhat larger than the predetermined value. In any event, the feed-in station 81 is returned here to the passive mode when the head 51 with the feed-out station 83 put in the passage or holding modes comes to a standstill insofar as the horizontal directions are concerned. It will now be readily seen that a relaxation oscillator may be substituted for the flip-flop circuit 234. The wire amount detection station 87 may be modified to produce the detection signal Sd while the length of the wire 40 stored in the guiding and storing station 82 is between a minimum allowable amount and a sufficient amount, with the receive control circuit modified accordingly.

Figure 18:
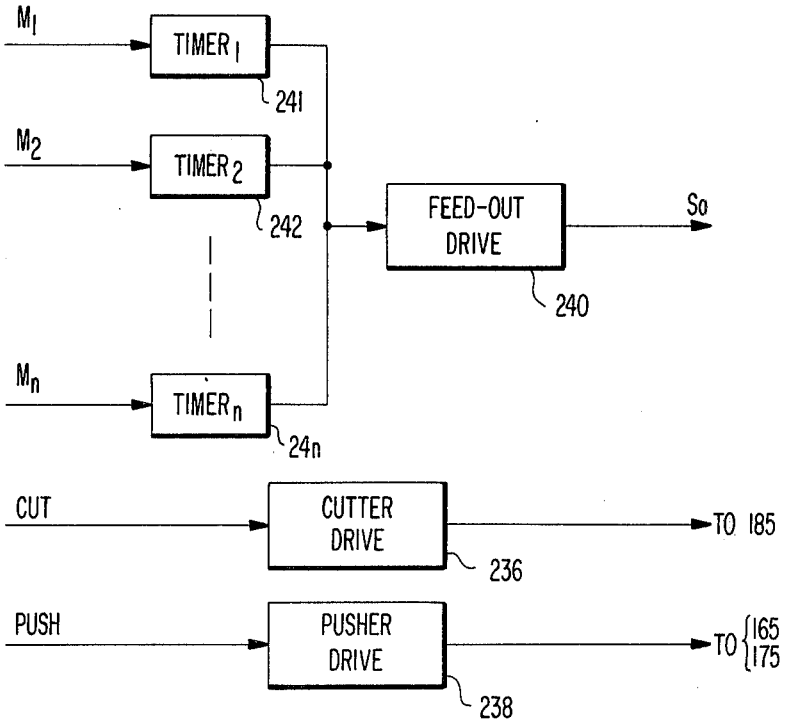
FIG. 18 likewise shows a block circuit diagram of another portion of the control unit.

Referring to FIG. 18, the wire cut and push control means includes a wire end control circuit comprising, in turn, a cutter drive circuit 236 responsive to a wire cut command CUT reproduced from the programmed tape for actuating the third air cylinder 185 to put the cutters 180 and 181 into their operative positions. The wire end control circuit further comprises a pusher drive circuit 238 responsive to a wire push command PUSH reproduced from the programmed tape for actuating the first and second air cylinders 165 and 175. The receive control circuit still further comprises a plurality of timers 241, 242, . . . , and 24*n*, *n* in number, responsive to wire end length commands $M_1$, $M_2$, . . . , and $M_n$, respectively, for producing output signals lasting for the duration specified by the respective end length commands. The timer output signal is supplied to a feed-out signal producing circuit 240 for producing the feed-out signal So mentioned above. It will be understood that the timers are capable of dealing with *n* different leading and trailing wire end lengths.

Referring to FIG. 19, it may happen that the movement of the wire outlet port tube tip 159 is hirdered by one or several segments of wires 40 which are already laid on the harness board 41 during formation of a cable harness. This will damage either or both of the tube tip 159 and the wire segment or segments. A countermeasure for this kind of trouble is proposed in the above-referenced Japanese Patent Disclosure. It is, however, impossible with this countermeasure to adjust both rigidity and flexibility of the outlet port tube 158.

Referring now to FIGS. 20 and 21, a modified wire outlet port 85 comprises a supporting pipe 156 rotatably and swingably held at its top end by a self-aligning bearing 157, a wire tube 158 put replaceably into the supporting tube 156 and having a slightly bent tip 159, and a generally cross-shaped intermediate plate 251 rotatably holding the supporting pipe 156 through a radial bearing 252 and swingably held by a plurality of ball catcher pairs situated in a casing 255. Each ball catcher comprises a compression coil spring 256, a ball 257 received between the intermediate plate 251 and one end of the spring 257, and a machine screw 258 fixing the other end of the spring 257 to the casing 255 so that the ball catcher pairs may resiliently hold the supporting pipe 156 through the intermediate plate 251 in place. The outlet port 85 further comprises a flange 261 attached to the supporting pipe 156 and a thrust bearing 262 interposed between the flange 261 and the intermediate plate 251 for receiving the thrust load. In addition, the outlet port 85 comprises a ring-shaped electrode 266 attached to the casing 255 and a plurality of finger electrodes 267 attached to the supporting pipe 156 facing the ring-shaped electrode 266. The opposing electrodes 266 and 267 are normally spaced apart but at least one of the finger electrodes 267 comes into contact with the ring-shaped electrode 266 when the movement of the outlet port 85 is hindered by at least one of the wire segments to produce an electric signal. It will now be appreciated that the modified outlet port 85 has adjustable rigidity and resiliency and that the electric signal produced thereby may make the control unit 59 raise the outlet port 85 to the highest level and alarm the operator of occurrence of a trouble.

Incidentally, it would have already been understood that the feed-in station 81 of the harness laying head 51 must be put in the active mode at least a moment before reception therein of the protruded free end of the selected wire 40 if use is made of the relaxation take up means illustrated with reference to FIGS. 2 and 3.

What is claimed is:

1. In a machine for use in combination with a wire supply station and a harness board for forming a cable harness comprising a plurality of wire segments on said harness board, said supply station accommodating a plurality of wires from which said wire segments are subsequently cut, said harness board having wire end retainer means attached thereto for retaining a free end of a wire, said machine comprising a harness laying head and head control means for moving said head relative to said harness board and supply station, said head capable of receiving predetermined one of said wires from said supply station and supplying the predetermined wire to said harness board to allow the free end of the predetermined wire to be retained by said retainer means, thereby laying the predetermined wire on said harness board to provide one of said wire segments, the improvement wherein said head comprises a wire feed-out station operable in a wire driving mode of positively driving the predetermined wire to said harness board, in a wire holding mode of holding the predetermined wire immovably relative to said head, and in a wire passage mode of allowing free passage therethrough of the predetermined wire, and said head control means comprises feed-out station control means for operating said feed-out station in timed relation to the movement of said head selectively in one of said wire driving mode in which the free end of the predetermined wire may be retained by said retainer means, said wire holding mode in which one of said wire segments may be cut from the predetermined wire, and said wire passage mode in which the predetermined wire may be laid on said harness board as said head is moved by said head control means, said head further comprising a wire outlet port for allowing passage therethrough of the predetermined wire from said feed-out station to said harness board, a wire cutting and pushing station between said feed-out station and said outlet port, said cutting and pushing station being operable in a wire freeing mode of allowing free passage therethrough of the wire not held by said feed-out station, in a wire cutting mode of cutting the wire held by said feed-out station into a wire section having a trailing end in said cutting and pushing station and a remainder continuing to said supply station, and in a wire pushing mode of pushing said trailing end substantially out of said outlet port, and said head control means comprises wire cut and push control means for operating said cutting and pushing station in timed relation to the operation of said feed-out station selectively in one of said wire freeing mode in which the predetermined wire is laid on said harness board by said head moved by said head control means, said wire cutting mode, and said wire pushing mode in which said wire section is eventually laid on said harness board as one of said wire segments.

2. A machine as claimed in claim 1, wherein said wire cutting and pushing station comprises a cutter adjacent to said outlet port, a wire guide pipe on the opposite side of said outlet port with respect to said cutter and having a first end capable of being put in a first position aligned with said outlet port and in a second position offset with respect to said outlet port, and a longitudinally movable rod-shaped pusher on the opposite side of said outlet port with respect to said cutter and having a first end capable of being put in a first position offset with respect to said outlet port and in a second position aligned with said outlet port, said cutter capable of being put in an operative position and in an inoperative position, and said wire cut and push control means puts said cutter, wire guide pipe first end, and pusher first end in their respective inoperative, first, and first positions during said wire freeing mode, in their respective operative, first, and first positions during said wire cutting mode, and in their respective inoperative, second, and second positions during said wire pushing mode.

3. A machine as claimed in claim 2, wherein said wire guide pipe is flexible and has a second end disposed adjacent to said feed-out station.

4. A machine as claimed in claim 1, said head comprising a wire inlet port for allowing passage therethrough of the predetermined wire between said wire supply station and said feed-out station; wherein said head further comprises a wire feed-in station and a wire guiding and storing station between said inlet port and said feed-out station, said feed-in station being operable in an active mode of driving the predetermined wire to said guiding and storing station, in a passive mode of preventing the predetermined wire from moving from said guiding and storing station to said inlet port, and in a free mode of allowing free passage therethrough of the predetermined wire between said inlet port and said feed-out station, said guiding and storing station being operable in a wire guiding mode and in a storing mode, and said head control means comprises wire receive and store control means for operating said feed-in and said guiding and storing stations in timed relation to the operation of said feed-out station in one of the combinations of said active and wire guiding modes in which the predetermined wire driven by said feed-in station is guided along said guiding and storing station to said feed-out station, said active and storing modes with said feed-out station put in said wire passage mode in which the predetermined wire stored in said guiding and storing station increases in length, said passive and wire storing modes with said feed-out station put in said wire passage mode in which the predetermined wire stored in said guiding and storing station decreases in length, and said free and storage mode in which the predetermined wire may be pulled back to said wire supply station.

5. A machine as claimed in claim 4, wherein said feed-out station comprises a first capstan rotatable around a first axis fixed relative to said guding and storing station and a second capstan rotatable around a second axis parallel to and movable relative to said first axis and said feed-out station control means comprises operating means for operating said capstans in said wire driving mode of urging said second capstan to said first capstan and rotating said first capstan in a predetermined sense, in said wire holding mode of urging said second capstan to said first capstan and preventing said first capstan from rotating in either sense, and in said wire passage mode of holding said second capstan out of contact with said first capstan and setting said first capstan freely rotatable in either sense.

6. A machine as claimed in claim 4, wherein said guiding and storing station comprises a first guide fixed relative to said feed-in and feed-out stations and defining one of opposing boundaries of a planar roundabout route for guiding the predetermined wire therealong and a second guide movable relative to said first guide perpendicularly of the plane of said roundabout route between a forward position of defining the other of said boundaries and a retracted position of providing a wire storing region bounded on one side by said first guide for storing the predetermined wire and wherein said receive and store control means comprises operating means for putting said second guide selectively in one of said forward and retracted positions.

7. A machine as claimed in claim 6, wherein said operating means comprises an electromagnetic solenoid operatively coupled to said second guide and operable in one of said wire guiding mode of placing said second guide in said forward position and in said wire storing mode of placing said second guide in said retracted position.

8. A wire supply station for use in combination with a harness board and a machine for forming a cable harness comprising a plurality of wire segments on said harness board, said supply station including a plurality of reels for a plurality of wires from which said wire segments are subsequently cut, said harness board having wire end retainer means attached thereto for retaining a free end of a wire, said machine comprising a harness laying head and head control means for moving said head relative to said harness board and supply station, said head capable of receiving predetermined one of said wires from said supply station and supplying the predetermined wire to said harness board to allow the free end of the predetermined wire to be retained by said retainer means, thereby laying the predetermined wire on said harness board to provide one of said wire segments, said head comprising a wire feed-out station operable in a wire driving mode of positively driving the predetermined wire to said harness board, in a wire holding mode of holding the predetermined wire immovably relative to said head, and in a wire passage mode of allowing free passage therethrough of the predetermined wire, said head control means comprising feed-out station control means for operating said feed-out station in timed relation to the movement of said head selectively in one of said wire driving mode in which the free end of the predetermined wire may be retained by said retainer means, said wire holding mode in which one of said wire segments may be cut from the predetermined wire, and said wire passage mode in which the predetermined wire may be laid on said harness board as said head is moved by said head control means, wherein the improvement comprises a plurality of wire clampers for the respective wires continuing to said reels and having free ends, each of said clampers having a forward side to be directed to said machine and harness board and comprising first means for holding relevant one of said wires releasably and immovably relative to said forward side with the free end of said relevant wire protruding approximately a preselected length forwardly of said forward side and second means operatively coupled to said first means and operable by said head put in a predetermined position relative to said forward side to release the holding by said first means of said relevant wire, thereby allowing said relevant wire to be received at said protruding free end as the predetermined wire by said head put in said predetermined position and eventually driven by said feed-out station operated in said wire driving mode.

9. A wire supply station as claimed in claim 8, said head comprising a wire inlet tube substantially horizontally protruding towards said supply station and a protrusion protruding also towards said supply station at a predetermined level above said inlet tube, wherein said first means comprises a wire guide tube disposed substantially horizontally and longitudinally slidably relative to said forward side for guiding said relevant wire therethrough, spring means for urging said wire guide tube to a forward position nearer to said head, latch means for releasably holding said wire guide tube against the action of said spring means in a retracted position, and lock means for releasably holding said relevant wire against the inside surface of said wire guide tube while said wire guide tube is held in said retracted position, whereby said first means releasably holds said relevant wire, and said second means comprises a pin member at said predetermined level above said wire guide tube for engagement with said head protrusion when said head is put in said predetermined position and latch and lock release means operatively coupled to said pin member, latch means, and lock means for releasing the holding by said latch means of said wire guide tube and by said lock means of said relevant wire when said pin member engages with said head protrusion, thereby allowing said spring means to urge said wire guide tube to said forward position where said tube is in aligned contact with said inlet tube whereby said relevant wire is received in said head and eventually driven by said feed-out station operated in said wire driving mode.

10. A wire supply station as claimed in claim 8, wherein the improvement further comprises a reel station on the opposite side of said wire clampers with respect to said head and a plurality of tension sensors between said reel station and wire clampers, each of said tension sensors being operatively coupled to relevant one of said wires for detecting the tension in said coupled wire to produce an electric signal when said tension decreases to a predetermined value, said reel station comprising said reels and means responsive to said electric signal for selectively rotating relevant one of said reels to make said relevant reel take up said coupled wire.

11. In a harness board for use in combination with a wire supply station and a machine for forming a cable harness comprising a plurality of wire segments on said harness board, said supply station accommodating a plurality of wires from which said wire segments are subsequently cut, said harness board having a wire end retainer for retaining a free end of a wire, said retainer including a base to be removably attached to said harness board, said machine comprising a harness laying head and head control means for moving said head relative to said harness board and supply station, said head capable of receiving predetermined one of said wires from said supply station and supplying the predetermined wire to said harness board through a wire outlet tube protruding towards said harness board to allow the free end of the predetermined wire to be retained by said retainer, thereby laying the predetermined wire on said harness board to provide one of said wire segments, said head comprising a wire feed-out station operable in a wire driving mode of positively driving the predetermined wire to said harness board through said outlet tube, in a wire holding mode of holding the predetermined wire immovably relative to said head, and in a wire passage mode of allowing free passage therethrough of the predetermined wire, said head control means comprising feed-out station control means for operating said feed-out station in timed relation to the movement of said head selectively in one of said wire driving mode in which the free end of the predetermined wire may be retained by said retainer, said wire holding mode in which one of said wire segments may be cut from the predetermined wire, and said wire passage mode in which the predetermined wire may be laid on said harness board through said outlet tube as said head in moved by said head control means, the improvement wherein said retainer comprises a peripheral wall defining a hole through said base for free passage therethrough of said outlet tube, a pair of wire retainer rods fixed to said base on one side of said hole so as to allow free passage therebetween of said outlet tube transversely thereof, and a sheet of a resilient material held by said base extending into said hole from the other side thereof with a portion of said hole left between an edge of said sheet disposed in said hole and an opposing portion of said wall, said sheet having a slit communicating with said hole portion and being yieldable to allow putting into said slit of said outlet tube by the head moved by said head control means and capable of holding the wire guided by and protruded from said outlet tube by said feed-out station operated in said wire driving mode after pulling of said outlet tube out of said slit by said head moved away from said base unless said head is moved farther away from said base with said feed-out station operated in said wire holding mode.

12. A harness board as claimed in claim 11, said wire segments being divided into a plurality of wire segment groups laid on said harness board at different wire levels, respectively, said harness board having a wire holder comprising a holder rod removably attached to said harness board for guiding the wire segments being laid by said head on said harness board, wherein said wire holder comprises a plurality of level pins attached to said wire holder rod substantially at the wire levels of the wire segment groups to be guided by said wire holder rod and extending parallel to said harness board.

13. In a machine for forming a complicated and large-scale cable harness, comprising a stationary wire supply station including rotatable reels for a plurality of wires, a harness board having a plurality of wire end retainers attached thereto, a harness laying head which includes a wire payout tube and means for receiving one of said wires and is movable over said harness board to lay said one wire thereon from said payout tube, and head control means for moving said head along a predetermined path, the improvement wherein:

said wire supply station comprises a plurality of wire clampers for releasably clamping the respective wires and for releasing, when said harness laying is moved along said predetermined path adjacent to relevant one thereof, the wire clamped by said relevant wire clamper to place a free end of the released wire in said head, said harness laying head comprising a wire feed-in station, a wire storing station, a wire feed-out station, and a wire cutting and pushing station, said feed-in station driving said released wire to said feed-out station through said storing station, said feed-out station feeding the wire driven thereto to said wire payout tube through said cutting and pushing station, said cutting and pushing station capable of cutting the wire placed therein into two section, one leading to said relevant wire clamper through said feed-out, storing and feeding stations, the other remaining in said payout tube, and of pushing said other wire section out of said payout tube, said storing station capable of storing a length of said driven wire, and each of said wire end retainers comprising a wire end holder for removably holding a free end of one of said wires, a wire end receiver for receiving those free ends of wires which are moved thereinto from said end holder, and a pair of rods on the opposite side of said end holder with respect to said end receiver for allowing free passage therebetween of said wire payout tube, said wire supply station further comprising wire tension means for sensing tension of a wire extending between the reel therefor and said wire payout tube through which the last-mentioned wire is laid along a predetermined path and for making the last-mentioned reel take up said last-mentioned wire as soon as the tension decreases below a predetermined value.

14. A machine as claimed in claim 13, wherein said wire feed-in station is selectively operable in an active mode of driving said released wire to said wire storing station, in a passive mode of preventing the predetermined wire from moving from said storing station back to said wire supply station, and in a free mode of allowing free passage therethrough of said released wire, said wire storing station is selectively operable in a wire guiding mode of guiding the wire driven thereto by said feed-in station to said feed-out station and in a wire storing mode of storing said length, said wire feed-out station being selectively operable in a wire driving mode of positively driving the wire driven thereto by said feed-in station to said harness board through said wire payout tube, in a wire holding mode of holding the last-mentioned wire immovably relative thereto, and in a wire passage mode of allowing free passage therethough of the last-mentioned wire, and said wire cutting and pushing station being selectively operable in a wire freeing mode of allowing free passage therethrough of the last-mentioned wire while said feed-out station is not put in said holding mode, in a wire cutting mode of cutting the last-mentioned wire while said feed-out station is put in said holding mode, and in a wire pushing mode of pushing said other section of the last-mentioned wire out of said payout tube.

15. In a machine for use in combination with a wire supply station and a harness board for forming a cable harness comprising a plurality of wire segments on said harness board, said supply station accommodating a plurality of wires from which said wire segments are subsequently cut, said harness board having wire end retainer means attached thereto for retaining a free end of a wire, said machine comprising a harness laying head and head control means for moving said head relative to said harness board and supply station, said head capable of receiving predetermined one of said wires from said supply station and supplying the predetermined wire to said harness board to allow the free end of the predetermined wire to be retained by said retainer means, thereby laying the predetermined wire on said harness board to provide one of said wire segments, the improvement wherein said head comprises a wire feed-out station operable in a wire driving mode of positively driving the predetermined wire to said harness board, in a wire holding mode of holding the predetermined wire immovably relative to said head, and in a wire passage mode of allowing free passage therethrough of the predetermined wire, and said head control means comprises feed-out station control means for operating said feed-out station in timed relation to the movement of said head selectively in one of said wire driving mode in which the free end of the predetermined wire may be retained by said retainer means, said wire holding mode in which one of said wire segments may be cut from the predetermined wire, said wire passage mode in which the predetermined wire may be laid on said harness board as said head is moved by said head control means, said head comprising a wire outlet port for allowing passage therethrough of the predetermined wire from said feed-out station to said harness board, wherein said head further comprises a wire cutting and pushing station between said feed-out station and said outlet port, said cutting and pushing station being operable in a wire freeing mode of allowing free passage therethrough of the wire not held by said feed-out station, in a wire cutting mode of cutting the wire held by said feed-out station, in a wire cutting mode of cutting the wire held by said feed-out station into a wire section having a trailing end in said cutting and pushing station and a remainder continuing to said supply station, and in a wire pushing mode of pushing said trailing end substantially out of said outlet port, and said head control means comprises wire cut and push control means for operating said cutting and pushing station in timed relation to the operation of said feed-out station selectively in one of said wire freeing mode in which the predetermined wire is laid on said harness board by said head moved by said head control means, said wire cutting mode, said wire pushing mode in which said wire section is eventually laid on said harness board as one of said wire segments, said wire cutting and pushing station comprising a cutter adjacent to said outlet port, a wire guide pipe on the opposite side of said outlet port with respect to said cutter and having a first end capable of being put in a first position aligned with said outlet port and in a second position offset with respect to said outlet port, and a longitudinally movable rod-shaped pusher on the opposite side of said outlet port with respect to said cutter and having a first end capable of being put in a first position offset with respect to said outlet port and in a second position aligned with said outlet port, said cutter capable of being put in an operative position and in an inoperative position, said wire cut and push control means puts said cutter, wire guide pipe first end, and pusher first end in their respective inoperative, first, and first positions during said wire freeing mode, in their respective operative, first, and first positions during said wire cutting mode, in their respective inoperative, second, and second positions during said wire pushing mode, said pusher being flexible and having a second end, said pusher except its first end being disposed substantially along an arc of a circle with its second end disposed on said arc, and said wire cut and push control means comprising means operable during said wire pushing mode to reciprocatively move said pusher second end along said arc, thereby pushing said pusher first end into said outlet port and retracting the same out thereof.

16. A machine as claimed in claim 15, wherein said wire cutting and pushing station comprises an elongated member on the opposite side of said cutter with respect to said outlet port, said elongated member being longitudinally slidable transversely of a line aligned with said outlet port and having a pair of holes which are formed therethrough, said wire guide pipe first end being connected to one of said holes, said pusher first end extending through the other of said holes.

17. A machine as claimed in claim 16, wherein said cutter comprises a pair of cutter edges on both sides of said line and in parallel to said elongated member and cutting and pushing station further comprises a pair of connector pipes in said holes in alignment with said wire guide pipe first end and for allowing passage of said pusher first end through one thereof, respectively, and spring means for urging said connector pipes to said cutter edges.

18. In a machine for use in combination with a wire supply station and a harness board for forming a cable harness comprising a plurality of wire segments on said harness board, said supply station accommodating a plurality of wires from which said wire segments are subsequently cut, said harness board having wire and retainer means attached thereto for retaining a free end of a wire, said machine comprising a harness laying head and head control means for moving said head relative to said harness board and supply station, said head capable of receiving predetermined one of said wires from said supply station and supplying the predetermined wire to said harness board to allow the free end of the predetermined wire to be retained by said retainer means, thereby laying the predetermined wire on said harness board to provide one of said wire segments, the improvement wherein said head comprises a wire feed-out station operable in a wire driving mode of positively driving the predetermined wire to said harness board, in a wire holding mode of holding the predetermined wire immovably relative to said head, and in a wire passage mode of allowing free passage therethrough of the predetermined wire, and said head control means comprises feed-out station control means for operating said feed-out station in timed relation to the movement of said head selectively in one of said wire driving mode in which the free end of the predetermined wire may be retained by said retainer means, said wire holding mode in which one of said wire segments may be cut from the predetermined wire, said wire passage mode in which the predetermined wire may be laid on said harness board as said head is moved by said head control means, said head comprising a wire outlet port for allowing passage therethrough of the predetermined wire from said feed-out station to said harness board, wherein said head further comprises a wire cutting and pushing station between said feed-out station and said outlet port, said cutting and pushing station being operable in a wire freeing mode of allowing free passage therethrough of the wire not held by said feed-out station, in a wire cutting mode of cutting the wire held by said feed-out station into a wire section having a trailing end in said cutting and pushing station and a remainder continuing to said supply station, and in a wire pushing mode of pushing said trailing end substantially out of said outlet port, and said head control means comprises wire cut and push control means for operating said cutting and pushing station in timed relation to the operation of said feed-out station selectively in one of said wire freeing mode in which the predetermined wire is laid on said harness board by said head moved by said head control means, said wire cutting mode, said wire pushing mode in which said wire section is eventually laid on said harness board as one of said wire segments, said wire outlet port comprising a casing, a supporting pipe, a wire tube replaceably received in said supporting pipe for guiding the predetermined wire therethrough from said cutting and pushing station towards said harness board, a self-aligning bearing holding said supporting pipe rotatably and swingably relative to said casing, an intermediate plate extending within said casing transversely of said supporting pipe, a radial bearing between said supporting pipe and said intermediate plate for holding said supporting pipe rotatably relative to said intermediate plate, a plurality of first ball catchers on one side of said intermediate plate, a plurality of second ball catchers on the other side of said intermediate plate, and means for adjustably fixing said first and second ball catchers relative to said casing so as to make said ball catchers hold said supporting pipe centrally of said casing with adjusted rigidity and resiliency.

19. A machine as claimed in claim 18, wherein said wire outlet port further comprises a plurality of first electrodes carried by said supporting pipe and a second electrode fixed to said casing around said first electrodes, said first electrodes being not in contact with said second electrodes while said supporting pipe is held centrally of said casing, at least one of said first electrodes becoming into contact with said second electrode when said supporting pipe swings.

20. In a machine for use in combination with a wire supply station and a harness board for forming a cable harness comprising a plurality of wire segments on said harness board, said supply station accommodating a olurality of wires from which said wire segments are subsequently cut, said harness board having wire end retainer means attached thereto for retaining a free end of a wire, said machine comprising a harness laying head and head control means for moving said head relative to said harness board and supply station, said head capable of receiving predetermined one of said wires from said supply station and supplying the predetermined wire to said harness board to allow the free end of the predetermined wire to be retained by said retainer means, thereby laying the predetermined wire on said harness board to provide one of said wire segments, the improvement wherein said head comprises a wire feed-out station operable in a wire driving mode of positively driving the predetermined wire to said harness board, in a wire holding mode of holding the predetermined wire immovably relative to said head, and in a wire passage mode of allowing free passage therethrough of the predetermined wire, and said head control means comprises feed-out station control means for operating said feed-out station in timed relation to the movement of said head selectively in one of said wire driving mode in which the free end of the predetermined wire may be retained by said retainer means, said wire holding mode in which one of said wire segments may be cut from the predetermined wire, said wire passage mode in which the predetermined wire may be laid on said harness board as said head is moved by said head control means, said head comprising a wire inlet port for allowing passage therethrough of the predetermined wire between said wire supply station and said feed-out station, wherein said head further comprises a wire feed-in station and a wire guiding and storing station between said inlet port and said feed-out station, said feed-in station being operable in an active mode of driving the predetermined wire to said guiding and storing station, in a passaive mode of preventing the predetermined wire from moving from said guiding and storing station to said inlet port, and in a free mode of allowing free passage therethrough of the predetermined wire between said inlet port and said feed-out station, said guiding and storing station being operable in a wire guiding mode and in a storing mode, said head control means comprises wire receive and store control means for operating said feed-in and said guiding and storing stations in timed relation to the operation of said feed-out station in one of the combinations of said active and wire guiding modes in which the predetermined wire driven by said feed-in station is guided along said guiding and storing station to said feed-out station, said active and storing modes with said feed-out station put in said wire passage mode in which the predetermined wire stored in said guiding and storing station increases in length, said passive and wire storing modes with said feed-out station put in said wire passage mode in which the predetermined wire stored in said guiding and storing station decreases in length, and said free and storage mode in which the predetermined wire may be pulled back to said wire supply station, said feed-out station comprises a first capstan rotatable around a first axis fixed relative to said guiding and storing station and a second capstan rotatable around a second axis parallel to and movable relative to said first axis, said feed-out station control means comprises operating means for operating said capstans in said wire driving mode of urging said second capstan to said first capstan and rotating said first capstan in a predetermined sense, in said wire holding mode of urging said second capstan to said first capstan and preventing said first capstan from rotating in either sense, and in said wire passage mode of holding said second capstan out of contact with said first capstan and setting said first capstan freely rotatable in either sense, said operating means comprises a rotating primary shaft, a secondary shaft rotatable together with said first capstan, an electromagnetic clutch between said primary and secondary shafts and operable selectively in one of an engaged mode of transmitting the torque from said primary shaft to said secondary shaft, a rotation preventing mode of preventing said secondary shaft from rotating in either sense, and a disengaged mode of setting said secondary shaft freely rotatable in either sense, and an electromagnetic solenoid operatively coupled to said second axis and operable selectively in one of a capstan urging mode of urging said second capstan to said first capstan and a capstan liberating mode of holding said second capstan out of contact with said first capstan.

21. In a machine for use in combination with a wire supply station and a harness board for forming a cable harness comprising a plurality of wire segments on said harness board, said supply station accommodating a plurality of wire from which said wire segments are subsequently cut, said harness board having wire end retainer means attached thereto for retaining a free end of a wire, said machine comprising a hearness laying head and head control means for moving said head relative to said harness board and supply station, said head capable of receiving predetermined one of said wires from said supply station and supplying the predetermined wire to said harness board to allow the free end of the predetermined wire to be retained by said retainer means, thereby laying the predetermined wire on said harness board to provide one of said wire segments, the improvement wherein said head comprises a wire feed-out station operable in a wire driving mode of positively driving the predetermined wire to said harness board, in a wire holding mode of holding the predetermined wire immovably relative to said head, and in a wire passage mode of allowing free passage therethrough of the predetermined wire, and said head control means comprises feed-out station control means for operating said feed-out station in timed relation to the movement of said head selectively in one of said wire driving mode in which the free end of the predetermined wire may be retained by said retainer means, said wire holding mode in which one of said wire segments may be cut from the predetermined wire, said wire passage mode in which the predetermined wire may be laid on said harness board as said head is moved by said head control means, said head comprising a wire inlet port for allowing passage therethrough of the predetermined wire between said wire supply station and said feed-out station, wherein said head further comprises a wire feed-in station and a wire guiding and storing station between said inlet port and said feed-out station, said feed-in station being operable in an active mode of driving the predetermined wire to said guiding and storing station, in a passive mode of preventing the predetermined wire from moving from said guiding and storing station to said inlet port, and in a free mode of allowing free passage therethrough of the predetermined wire between said inlet port and said feed-out station, said guiding and storing station being operable in a wire guiding mode and in a storing mode, said head control means comprises wire receive and store control means for operating said feed-in and said guiding and storing stations in timed relation to the operation of said feed-out station in one of the combinations of said active and wire guiding modes in which the predetermined wire driven by said feed-in station is guided along said guiding and storing station to said feed-out station, said active and storing modes with said feed-out station put in said wire passage mode in which the predetermined wire stored in said guiding and storing station increases in lenght, said passive and wire storing modes with said feed-out station put in said wire passage mode in which the predetermined wire stored in said guiding and storing station decreases in length, and said free and storage mode in which the predetermined wire may be pulled back to said wire supply station, said guiding and storing station comprises a first guide fixed relative to said feed-in and feed-out stations and defining one of opposing boundaries of a planar roundabout route for guiding the predetermined wire therealong and a second guide movable relative to said first guide perpendicularly of the plane of said roundabout route between a forward position of defining the other of said boundaries and a retracted position of providing a wire storing region bounded on one side by said first guide for storing the predetermined wire, said receive and store control means comprises operating means for putting said second guide selectively in one of said forward and retracted positions, said head comprises a wire amount detection station operatively coupled to said storing region for producing a detection signal when the length of the predetermined wire stored in said storing region decreases to a predetermined length.

22. A machine as claimed in claim 21, wherein said wire amount detection station comprises a lever pivotally fixed at one end relative to said first guide on the opposite side of said roundabout route with respect to said storing region and extending over said roundabout route parallel to and offset with respect to the plane of said route, the other end of said lever being bent into said storing region whereby said lever is turned to a predetermined angular position when the length of the stored wire decreases to said predetermined length, and a limit switch operatively coupled to said lever for producing said detection signal when said lever is turned to said predetermined angular position.

23. A machine as claimed in claim 21, wherein said feed-in station comprises a first capstan rotatable around a first axis fixed relative to said roundabout route and a second capstan rotatable around a second axis parallel to and movable relative to said first axis and said receive and store control means comprises operating means for operating said capstans in said active mode of urging said second capstan to said first capstan and rotating said first capstan in a predetermined sense, in said passive mode of urging said second capstan to said first capstan and preventing said first capstan from rotating in a sense opposite to said predetermined sense, and in said free mode of holding said second capstan out of contact with said first capstan and setting said first capstan freely roatatable in either sense.

24. A machine as claimed in claim 23, wherein said operating means comprises a rotating primary shaft, a secondary shaft rotatable together with said first capstan only in said predetermined sense, an electromagnetic clutch between said primary and secondary shafts and operable selectively in one of an engaged mode of transmitting the torque from said primary shaft to said secondary shaft and in a disengaged mode of setting said secondary shaft freely rotatable in either sense, and an electromagnetic solenoid operatively coupled to said second axis and operable selectively in one of a capstan urging mode of urging said second capstan to said first capstan and a capstan liberating mode of holding said second capstan out of contact with said first capstan.

25. A machine as claimed in claim 23, said head control means comprising means responsive to a head horizontal drive signal for moving said head parallel to said harness board, wherein said feed-out station control means comprises means responsive to a feed-out signal for operating said feed-out station in said wire driving mode and said receive and store control means comprises an OR gate responsive to either of said horizontal drive and feed-out signals for producing a first gate output signal, an AND gate responsive to said gate output and detection signals for producing a second gate output signal, and means responsive to said second gate output signal for operating said feed-in station in said active mode.

26. A wire end retainer for use in combination with a harness board of a cable harness forming machine, comprising a base plate having an elongated hole formed therethrough and defined by a hole peripheral wall, a pair of rods fixed to said base plate on one side of said hole, and a sheet of a resilient material held by said base plate extending into said hole from the other side thereof with a portion of said hole left between an edge of said sheet disposed in said hole and an opposing portion of said wall, said sheet having a slit communicating with said hole portion.

* * * * *

UNITED STATES PATENT AND TRADEMARK OFFICE

CERTIFICATE OF CORRECTION

PATENT NO. : 3,947,943

DATED : April 6, 1976

INVENTOR(S) : Takamasa Kokubo et al

It is certified that error appears in the above-identified patent and that said Letters Patent are hereby corrected as shown below:

IN THE ABSTRACT:

Line 5, after "station", insert -- and --;

Line 12, delete "made" and insert -- mode --.

IN THE SPECIFICATION:

Column 1, line 39, delete "Syo" and insert -- Syô --;

Column 6, line 46, delete "deenergized" and insert -- de-energized --;

Column 8, line 57, delete "anticlockwise" and insert --counterclockwise--;

line 68, delete "deenergized" and insert -- de-energized --;

Column 9, line 39, after "166", insert -- pivoted --;

Column 10, line 32, delete "fremework" and insert -- framework --;

Column 11, line 41, delete "has" and insert -- have --;

Column 14, line 20, after "block of", insert -- the --;

Column 15, line 49, delete "hirdered" and insert -- hindered --.

IN THE CLAIMS:

Column 18, line 7, delete "guding" and insert -- guiding --;

Column 21, line 8, after "laying", insert -- head --;

UNITED STATES PATENT AND TRADEMARK OFFICE

CERTIFICATE OF CORRECTION

PATENT NO. : 3,947,943

DATED : April 6, 1976 (Continued)

INVENTOR(S) : Takamasa Kokubo et al

It is certified that error appears in the above-identified patent and that said Letters Patent are hereby corrected as shown below:

Column 21, line 22, delete "section" and insert -- sections --;

Column 24, line 55, delete "olurality" and insert -- plurality --;

Column 25, line 23, delete "passaive" and insert -- passive --;

Column 26, line 14, delete "hearness" and insert -- harness --;

line 64, delete "lenght" and insert -- length --.

Signed and Sealed this

Twenty-seventh Day of July 1976

[SEAL]

*Attest:*

RUTH C. MASON
*Attesting Officer*

C. MARSHALL DANN
*Commissioner of Patents and Trademarks*